US009316102B2

(12) United States Patent
Patterson et al.

(10) Patent No.: US 9,316,102 B2
(45) Date of Patent: Apr. 19, 2016

(54) ROTORS FORMED USING INVOLUTE CURVES

(75) Inventors: Curtis Patterson, Calgary (CA); Alejandro Juan, Calgary (CA); Kristjan Gottfried, Vancouver (CA)

(73) Assignee: Exponential Technologies, Inc., Calgary (CA)

( * ) Notice: Subject to any disclaimer, the term of this patent is extended or adjusted under 35 U.S.C. 154(b) by 336 days.

(21) Appl. No.: 13/452,157

(22) Filed: Apr. 20, 2012

(65) Prior Publication Data

US 2012/0269669 A1 Oct. 25, 2012

Related U.S. Application Data

(60) Provisional application No. 61/477,469, filed on Apr. 20, 2011.

(51) Int. Cl.

| | |
|---|---|
| ***F01C 21/10*** | (2006.01) |
| ***F01C 1/08*** | (2006.01) |
| ***F01C 1/24*** | (2006.01) |
| ***F01C 1/16*** | (2006.01) |
| ***F01C 1/18*** | (2006.01) |
| ***F01C 1/10*** | (2006.01) |
| ***F01C 3/08*** | (2006.01) |

(52) U.S. Cl.
CPC . *F01C 1/084* (2013.01); *F01C 1/10* (2013.01); *F01C 3/08* (2013.01)

(58) Field of Classification Search
CPC ..... F01C 1/084; F01C 1/10; F01C 3/08
USPC ..... 418/195, 190, 198, 206.5
See application file for complete search history.

(56) References Cited

U.S. PATENT DOCUMENTS

| | | | |
|---|---|---|---|
| 514,990 | A | 2/1894 | Habersang et al. |
| 815,485 | A | 3/1906 | Stewart |
| 855,106 | A | 5/1907 | Hensel |
| 1,088,174 | A | 2/1914 | Perrot |
| 1,285,870 | A | 11/1918 | Wingqvist |
| 1,295,231 | A | 2/1919 | Stewart et al. |
| 1,647,167 | A | 11/1927 | Wildhaber |
| 1,682,759 | A | 9/1928 | Kocourek |
| 1,739,756 | A | 12/1929 | Granville |

(Continued)

FOREIGN PATENT DOCUMENTS

| | | | |
|---|---|---|---|
| CA | 1080990 | A1 | 7/1980 |
| CN | 201354837 | | 12/2009 |

(Continued)

OTHER PUBLICATIONS

The spherical Involute bevel gear: its geometry, kinematic behavior and standardization, Noh Gill Park and Hyoung Woo Lee, Journal of Mechanical Science and Technology 25 (4) (2011 1023-1034, Manuscript Receipved Dec. 11, 2009.*

(Continued)

*Primary Examiner* — Jorge Pereiro
*Assistant Examiner* — Deming Wan
(74) *Attorney, Agent, or Firm* — Dwayne E. Rogge; Schacht Law Office, Inc.

(57) ABSTRACT

The present disclosure describes the use of involute curves for use in energy conversion devices, as well as timing or indexing gears. Several different embodiments are shown using rotors of several examples of lobe numbers and shapes.

17 Claims, 34 Drawing Sheets

(56) References Cited

U.S. PATENT DOCUMENTS

| | | | | | |
|---|---|---|---|---|---|
| 1,748,813 | A | | 2/1930 | Wildhaber | |
| 1,804,475 | A | | 5/1931 | Nash | |
| 2,266,108 | A | | 12/1941 | Welter | |
| 2,316,243 | A | | 4/1943 | Hubbard | |
| RE22,555 | E | | 10/1944 | Brooks | |
| 2,397,003 | A | | 3/1946 | Hambelton | |
| 2,551,735 | A | | 5/1951 | Goff | |
| 2,578,763 | A | | 12/1951 | Trbojevich | |
| 2,578,764 | A | | 12/1951 | Trbojevich | |
| 3,101,700 | A | * | 8/1963 | Bowdish | F02B 53/00 418/193 |
| 3,103,126 | A | | 9/1963 | Textrom | |
| 3,141,313 | A | | 7/1964 | Brickett et al. | |
| 3,273,341 | A | * | 9/1966 | Wildhaber | 123/204 |
| 3,856,440 | A | * | 12/1974 | Wildhaber | 418/195 |
| 3,884,050 | A | | 5/1975 | Borcuk | |
| 3,911,759 | A | | 10/1975 | Tanaka et al. | |
| 3,927,899 | A | | 12/1975 | Bough | |
| 4,947,942 | A | | 8/1990 | Lightle et al. | |
| 4,969,371 | A | | 11/1990 | Allen | |
| 5,513,969 | A | * | 5/1996 | Arnold | 418/195 |
| 5,613,914 | A | | 3/1997 | Gleasman et al. | |
| 6,036,463 | A | | 3/2000 | Klassen | |
| 6,887,057 | B2 | * | 5/2005 | Klassen | 418/195 |
| 8,689,766 | B2 | * | 4/2014 | Oledzki | 123/241 |
| 8,887,592 | B2 | | 11/2014 | Patterson et al. | |
| 2001/0055992 | A1 | | 12/2001 | Basstein | |
| 2007/0274853 | A1 | * | 11/2007 | Merendeiro et al. | 418/206.5 |
| 2010/0074786 | A1 | | 3/2010 | Juan et al. | |

FOREIGN PATENT DOCUMENTS

| | | | | | |
|---|---|---|---|---|---|
| JP | 52014904 | A | * | 2/1977 | F04C 3/00 |
| JP | 61112860 | A | | 3/1986 | |
| JP | 2002021979 | A | | 1/2002 | |
| JP | 2005048903 | A | | 2/2005 | |
| WO | 9533936 | A1 | | 12/1995 | |
| WO | 9911944 | A1 | | 3/1999 | |
| WO | 2011025160 | A2 | | 3/2011 | |
| WO | WO2011156924 | | | 12/2011 | |

OTHER PUBLICATIONS

Geometry and Design of Involute Spur Gears With Asymmetric Teeth, Alexander Kapelevich, Apr. 1998.

Giorgio Figliolini and Jorge Angeles, Algorithms for Involute and Octoidal Bevel-Gear Generation, Journal of Mechanical Design vol. 127, Jul. 2005, 9 pages.

International Searching Authority, ISR, PCT/CA2012/050303, Aug. 3, 2012, 10 pages.

Wikipedia, Gear Coupling, http://en.wikipedia.org/wiki/Gear_coupling, May 4, 2011, 1 page.

* cited by examiner

ROTORS FORMED USING INVOLUTE CURVES

RELATED APPLICATIONS

Priority is claimed to U.S. Provisional Patent Application Ser. No. 61/477,469, filed Apr. 20, 2011 incorporated herein by reference.

BACKGROUND OF THE DISCLOSURE

Field of the Disclosure

The present disclosure describes the use of involute curves for use in energy conversion devices, as well as timing or indexing gears.

SUMMARY OF THE DISCLOSURE

Disclosed in several embodiments is a device comprising a first rotor and a second rotor. In several embodiments, the rotational axes of the first rotor and the second rotor are offset from collinear and intersecting. Each rotor comprising: at least one lobe having a first side and a second side, wherein the first side of each lobe is a curved surface, formed of at least one spherical involute curve. The lobes of the first rotor intermesh with the lobes of the second rotor, around the periphery of the rotors. In one form, the device described is formed wherein the first side of each lobe of the first rotor contacts the first side of associated lobes on the second rotor.

The device disclosed herein may further comprise undercuts in the first sides of the lobes to provide clearance for the lobe tips of the opposing rotor.

The device disclosed may be arranged wherein the second side of the lobe is a teardrop/oval shape in cross section. The teardrop surface is formed to allow proper contact with the lobe tip of the opposing rotor during rotation of the device. The device may also be formed wherein the second side of the lobe is an offset or preload of the teardrop shape.

The rotors of the device may be formed wherein both the first sides and second sides of the lobes are comprised of involute curves.

The device may further comprise a housing having a prescribed gap between an outside diameter of the first rotor, and an inside diameter of housing. This prescribed gap may also be provided between an outside diameter of the second rotor, and the inside diameter of housing. The device may also utilize a varying gap between the first sides of the lobes of the first rotor and the first sides of the lobes of the second rotor during rotation.

To facilitate assembly and function, the device may further comprise a shroud encompassing the first rotor, and the second rotor. The shroud is substantially in contact with the outside diameters of the first rotor and the second rotor during rotation. During operation, the shroud rotates with the first and second rotor, and; the shroud positioned within the housing.

The device may further comprise a substantially spherical ball centered at the common center of the intersection of the axis of rotation of the first and second rotors. A gap may be provided between an inner spherical surface of at least one rotor and an outer diameter of the ball.

To be used as a compressor, or expander, the device may include surfaces defining ports, where at least one rotor comprises fluid inlet and/or outlet ports that are ported through a rear face of the rotor.

Although devices with many numbers of surfaces and lobes are disclosed, one embodiment is disclosed where the number of spherical involute derived surfaces is one per rotor.

The device may be formed where lobe spherical involute curves on each rotor have a helical-like shape, where the surface spans around a rotor close to, equal to or greater than 360 degrees and result in a fluid action during rotation of the rotors that is substantially in the axial direction. One embodiment of this variation is disclosed where the involute curves span greater than 360 degrees around the axis of the rotor, and the lobes form "fins" much like those of an auger, where both sides of the fins are comprised of involute surfaces and intended to engage fins the lobes of a mating (opposing) rotor.

In one form, the device is arranged where spherical involute lobe surfaces comprise a spiral transformation. In this embodiment, the involute curves on respective spherical planes that construct the lobe surfaces, radiate outward from a common center and reposition in an axial direction about a rotor axis. In this form, each spherical involute on each respective spherical plane may be rotated about the rotor axis by a predetermined rotation value.

Also disclosed herein is a bevel gear pair comprising a first gear rotor and an opposing gear rotor. The first gear rotor and the opposing gear rotor each comprise a plurality of teeth. In one form, each gear rotor comprises an equal number of teeth on each gear rotor. In one embodiment, one or more teeth of the first rotor are in contact with teeth on the opposing rotor in force transfer so as to transfer torque from the first gear rotor to the opposing gear rotor, and separate teeth on the first rotor are in contact or with prescribed gap or interference fit with teeth of the opposing rotor, to provide for backlash removal, and backlash removal and torque transfer do not occur on the same tooth of either rotor. This embodiment may be used in a machine comprising a first rotating component and a second rotating component. The bevel gear pair may be used as a timing gear between the first rotating component and the second rotating component. The bevel gear pair may be formed, where gear teeth are formed with a spiral transformation.

DESCRIPTION OF THE PREFERRED EMBODIMENTS

When a straight line rolls along a stationary circle a point on the line traces a curve called an involute (of the circle). When a circle rolls along a stationary straight line a point on the circumference of the circle traces a curve called a cycloid. When a circle rolls along another circle then a point on the circumference of the rolling circle traces out a curve called an epicycloid (if the rolling circle rolls on the outside of the stationary circle) or a hypocycloid (if the rolling circle rolls on the inside of the stationary circle). In all these cases of rolling circles points not on the circumference trace curves called trochoids.

All of the curves described above involve straight lines and circles in the plane. However, the same things can be applied to a sphere. The curves on a sphere that correspond to straight lines are the great circles (circles that divide the sphere into two equal halves) because great circles have the same symmetries on the spherical surface as do straight lines on the plane. On a sphere the "straight" lines are also circles. A circle on a spherical surface forms a cone from the center of the sphere; in the case of a great circle this cone is actually a planar disk. These cones and discs may be used to produce on a sphere the rolling of circles on circles.

The involute form has many advantages including close approximation to a rolling contact when two involutes are in synchronous rotating contact with one another when the central axis of the base cones of the involutes are offset from collinear. In this disclosure, an involute curve is defined as the curve described by the free end of a thread as it is wound around another curve, the evolute, such that its normals are tangential to the evolute.

Figure 9:
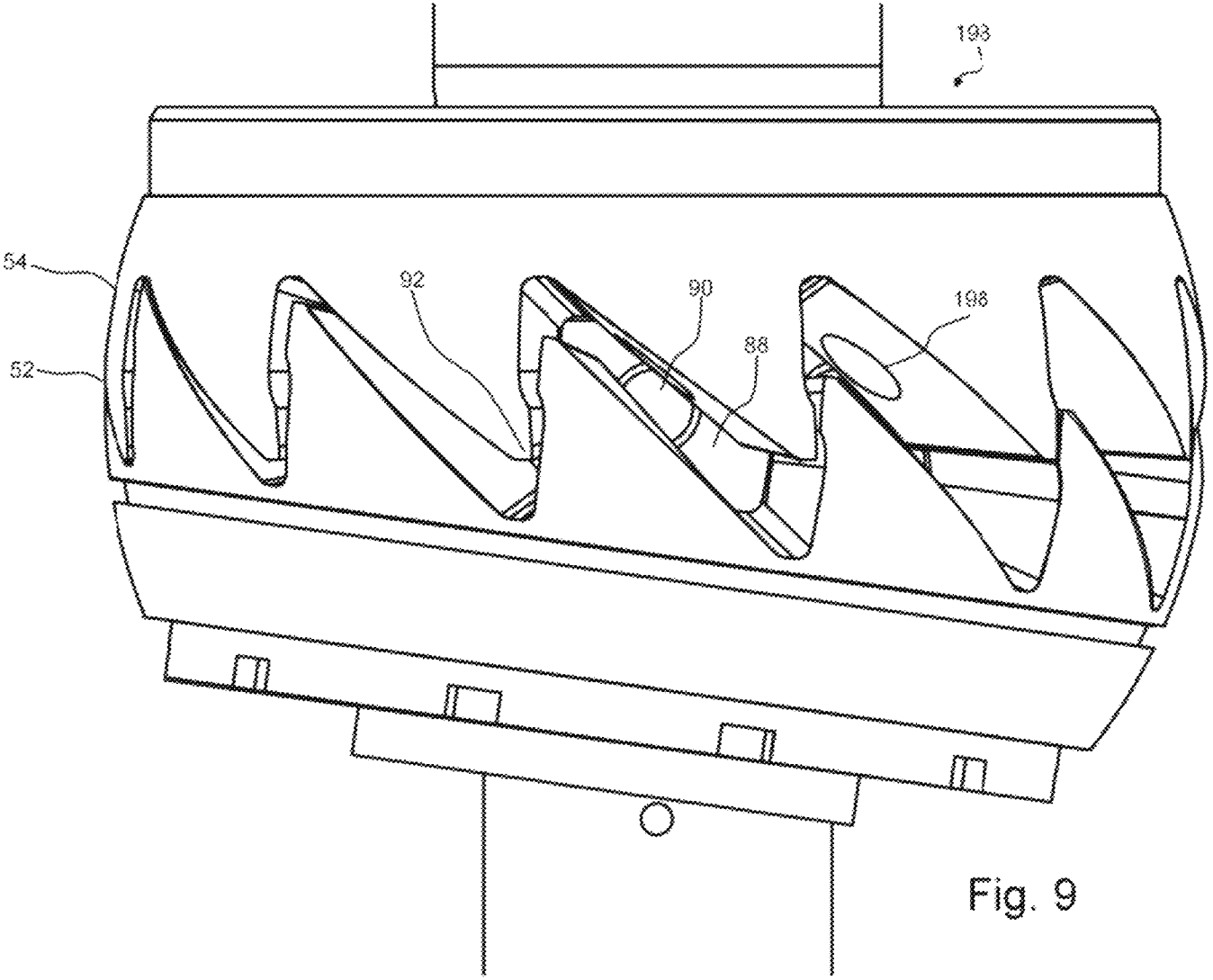
FIG. 9 shows one embodiment of a plurality of pump rotors.
Figure 32:
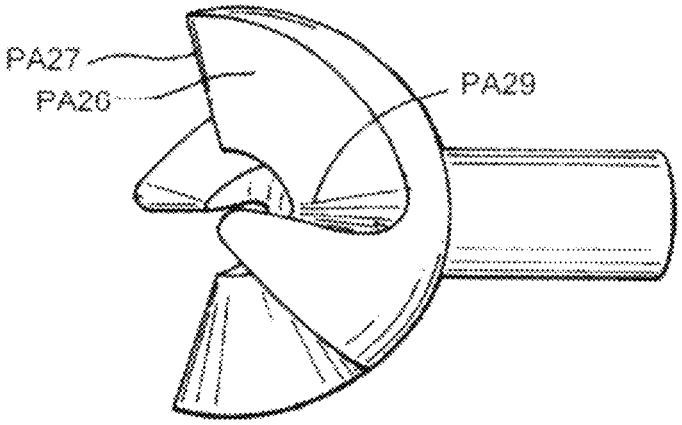
Fig. 32 Prior Art
FIG. 32 shows a prior art rotor and shaft.

This disclosure presents several uses of involutes for use in energy conversion devices, as well as the use of the spherical involute curves used as timing gears for rotors with axes that are offset from collinear, or rather, used in indexers as described for example in patent application Ser. No. 12/560,674 ('674) incorporated herein by reference. Further, machines used for energy conversion may also be formed whereby the entire set of primary contacting surfaces are comprised completely of spherical involute curves operating with axis offset from collinear and approximately intersect such as those illustrated in FIGS. 4-6. In these particular Figs. a suitable "shroud" on the outside, as well as a suitable inner ball with gap or contacting seals, are not always shown. U.S. patent application Ser. No. 13/162,436 ('436) incorporated herein by reference discloses similar shrouds in some detail. However, if one were to synchronously rotate the two rotors composed of spherical involute geometry, you obtain a fluid motion that generally propagates in the axial direction 56 of the rotors, similar to a screw compressor. The sawtooth lobe shape energy conversion device is also disclosed, where a teardrop geometry is created utilizing the bifurcation plane of the rotors as the cutter locations, is very similar to the energy conversion device lobe shown in U.S. Pat. No. 6,036,463 ('463) also incorporated herein by reference. The term "teardrop" is used herein as a portion of a curve created by the radially outward edge of a teardrop shape, bisected by a plane passing through the long axis of the teardrop. The teardrop lies on the surface of a spherical plane. However, using FIG. 7A from the '463 patent as an illustration, currently presented as FIG. 32, a surface similar to that of surface PA26 may be formed using a novel method that improves contact and load transfer. In the previous method, surface PA26 was formed by connecting the edge of the lobe tips PA27 to the edge of the lobe root PA29. In the improved method, the surface is formed by connecting the edge of the lobe tips PA27 to the edge of the lobe root PA29 with a spherical involute curve surface. This spherical involute curve surface is created by a plurality of spherical involute curves. Using FIG. 2 of this disclosure as an example, a first spherical involute curve 58 lies on an outer spherical plane corresponding to the outside diameter of the rotor. A second spherical involute 60 lies on the spherical plane corresponding to an inner ball 88, or hollow center of the rotor as shown in FIG. 9. The first 58 and second 60 involute curves need not be radial projections of the other; rather, they may have different pitches for example. The first 58 and second 60 involutes may be connected in one embodiment by a connecting surface 33. This connecting surface 33 in one form can be conceived as being composed of an infinite number of involute curves that lie on an infinite number of concentric spherical planes, and that the parameters that describe each of these infinite spherical involutes have some smooth progression from outer curve 58 to inner curve 60. The mating rotor in one form may also have surfaces with a similar smooth progression, such that the involute curve surfaces on a first rotor mesh with the involute curve surfaces of the mating rotor.

Figure 30:
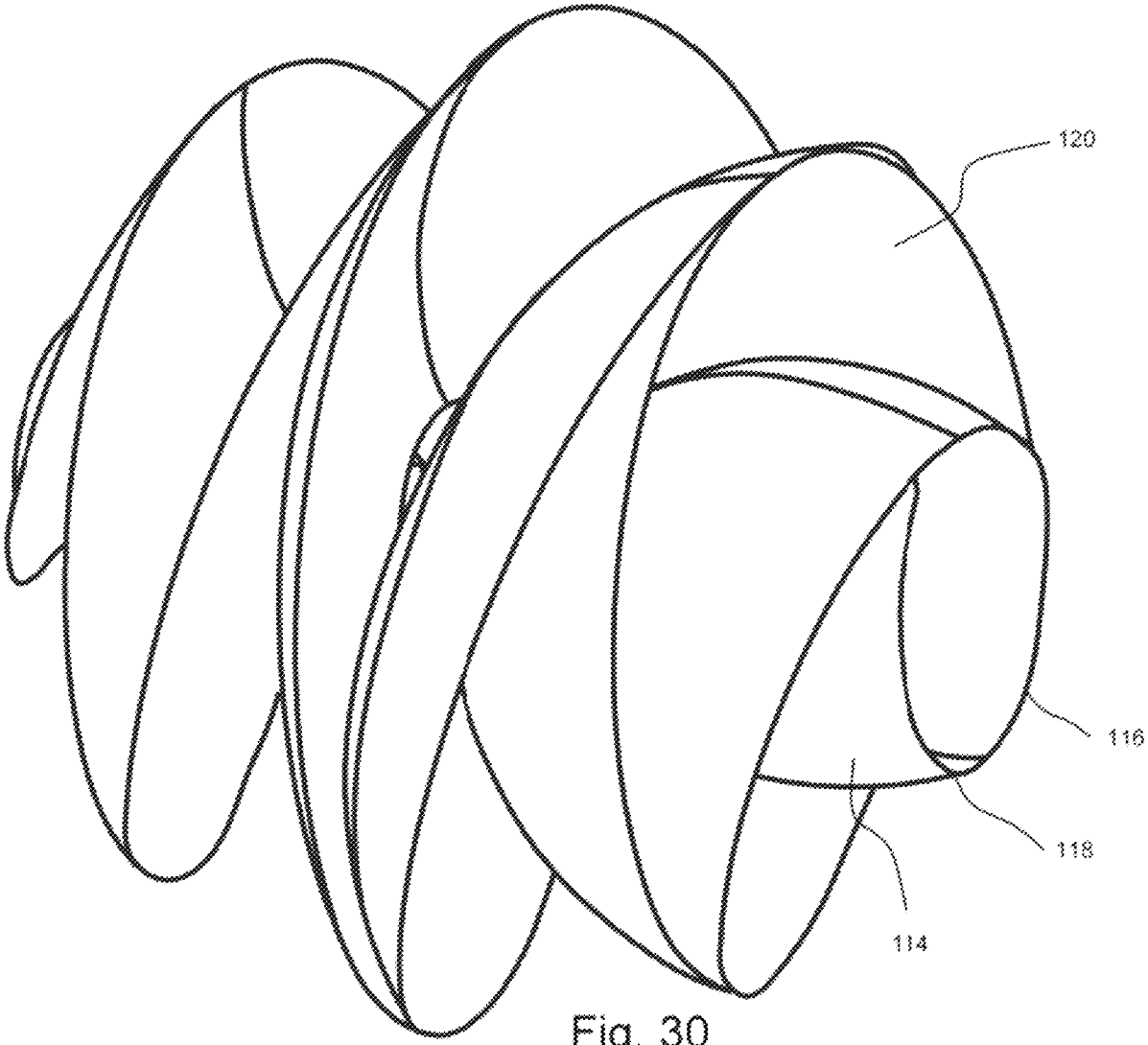
FIGS. 30 and 31 show a spherical involute elongate spiral transformation embodiment of the two rotor surfaces in contact.
Figure 31:
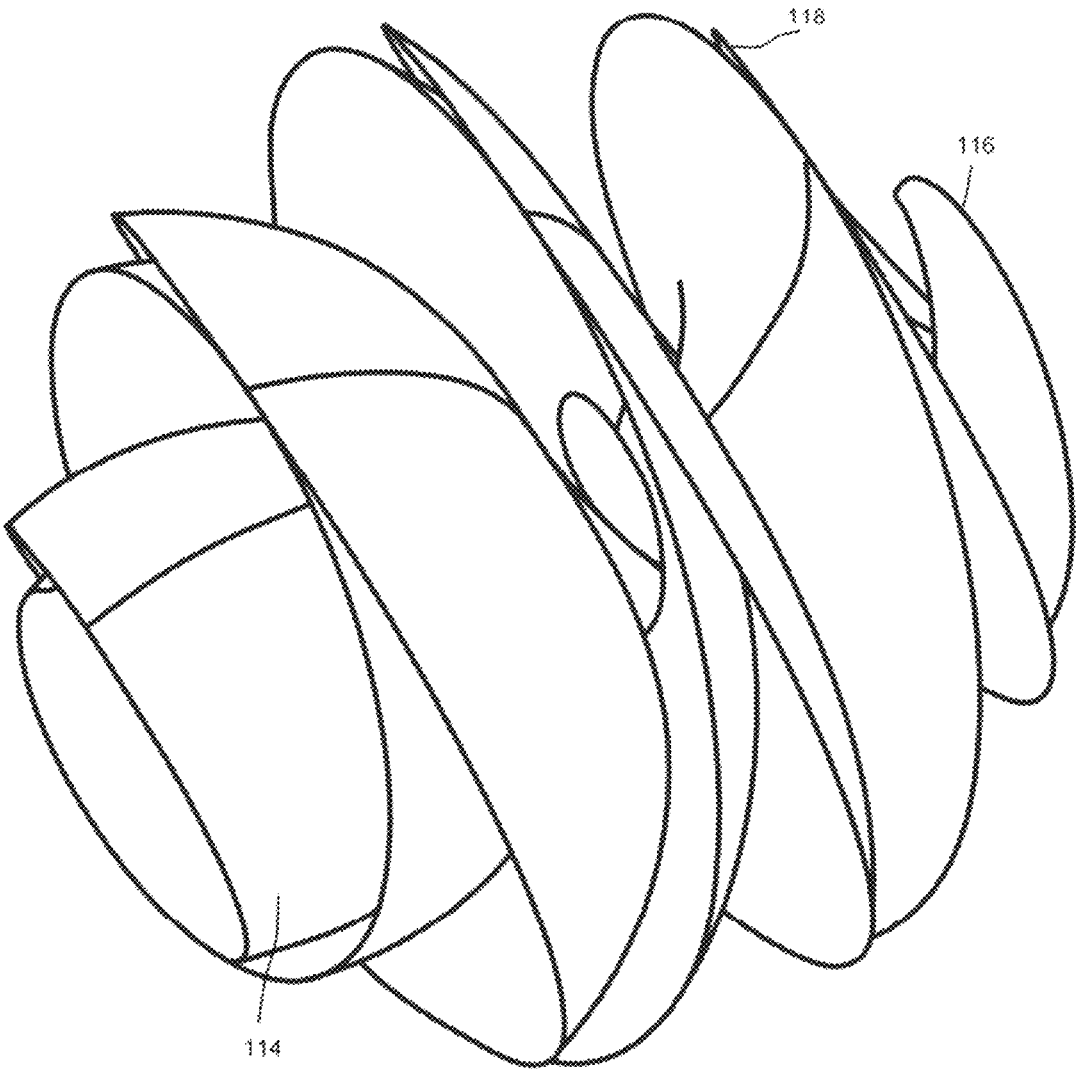

A spiral transformation could also be applied such that each of this infinite number of involute curves can be clocked by some tangential amount such as shown in the embodiments of FIGS. 30 and 31, smoothly, to create a spiral involute surface 114 on each rotor 116/118. Benefits of a spiral involute geometry are analogous to that of a spiral bevel gear, such as reducing machine noise, and increasing contact ratio and strength. It is also disclosed to construct a spiral spherical involute rotor that has greater than a full spiral twist, such a rotor could be used to create a device (pump, compressor, or engine) with an improved radial flow characteristic, where fluid volumes could be trapped by the spiral chambers resulting in a radial-flow device, that is, fluid flow could start from an inlet at the outside diameter of the rotors 116/118, become trapped (compressed/expanded) by the rotors as they rotate, and the flow could be directed toward the center of the rotors radially, through the spiral volumes 120. The opposite direction of flow could also occur by changing the spiral direction (shape of the rotors), or changing the direction of rotation of the rotors.

Figure 1:
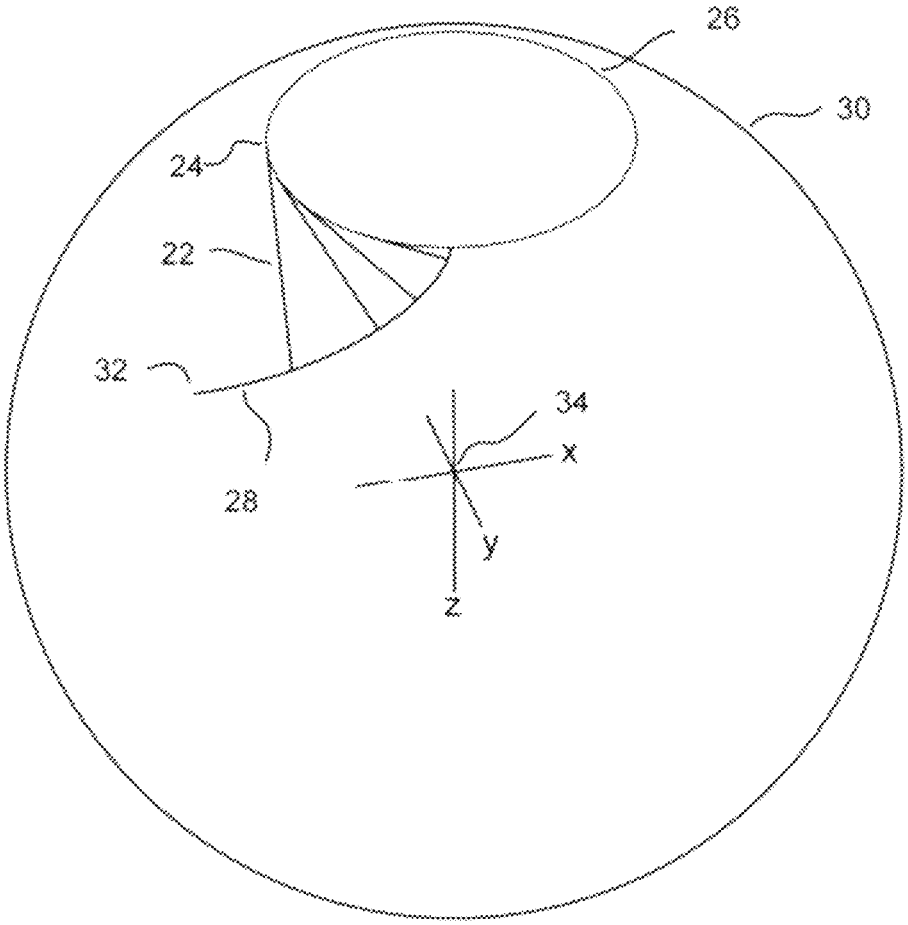
FIG. 1 is a depiction of one embodiment of an involute curve construct on the surface of a sphere.
Figure 2:
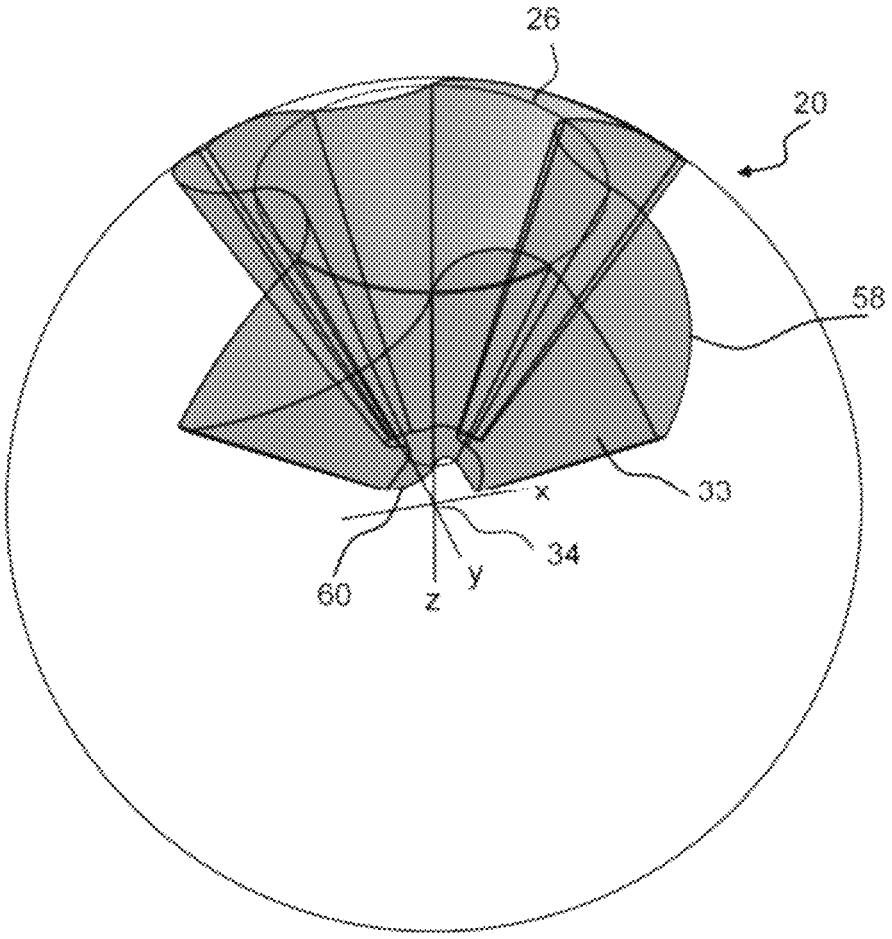
FIG. 2 is a depiction of one embodiment of a surface defined (formed) by a series of involute curve constructs extending from the outer surface of a reference sphere toward the center of the sphere.

On particular form of an involute curve is a spherical involute 20 which may be conceived as the set of points traversed by the tip of a string, as one unwraps a string from a circle upon the surface of a sphere while keeping it pulled tight, the circle being inscribed on the surface of a sphere. FIG. 1 illustrates this concept, where point 32 is the tip of the string 22, and points along the spherical involute curve 28 are created by the taught string 22 at various positions of being unwrapped. In one form, the string 22 forms a point of tangency 24 with the base circle 26. In one form, the string 22 is not a straight line, but rather, a great circle (a circle with center at sphere origin 34). FIG. 2 with spherical involute curve 28 illustrates a possible design for bevel-gear like timing gear that could be used in an energy conversion device with a through-shaft design for rotors that are offset from collinear.

Figure 3:
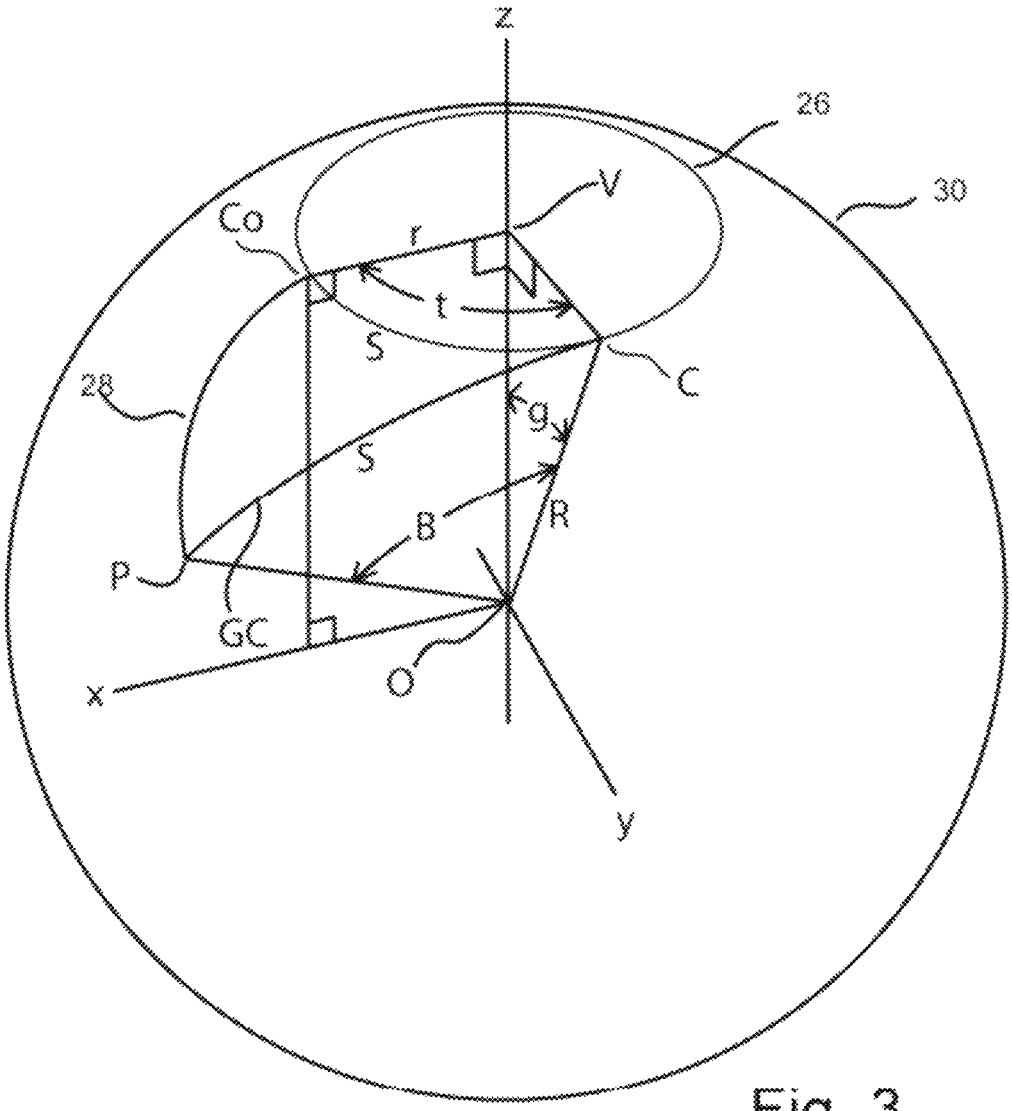
FIG. 3 shows one embodiment of a geometric framework for deriving the mathematics of a spherical involute curve.

To derive a mathematical construct of the spherical involute shape, one method is to use a series of vector rotations about a common center point. FIG. 3 illustrates this mathematical construct, with the assumption that the "string" being unwound starts being unwound at a point Co, aligned with the x-axis, and unraveling occurs in the counterclockwise direction, or rather, in a positive rotational direction about the z-axis by the right-hand-rule. Let "t" represent the angular position of the tangent point C located on the base circle. This tangent point traverses the base circle in a counter clockwise direction as point P of string GC is pulled off of the base circle. The arc length of great circle "GC" is equal to the arc length of the circular arc of the base circle between points Co and C and is denoted by S. Using the base circle 26, the arc length S=rt, where r is the radius of the base circle 26, t is the tangent point angle shown in FIG. 3. The half-angle of the base cone, as "g" is illustrated in FIG. 3, where the right triangle O V C demonstrates g=a sin(r/R) which can be rewritten as r=R sin(g) or r/R=sin(g), where R is the radius of the spherical plane of the involute. For spherical triangle P C O, we can write a relation S=RB, that is, angle B multiplied by radius R equals arc length S. Combine S=rt with S=RB to obtain rt=RB or r/R=B/t. For convenience, it is disclosed in one embodiment to write angle B in terms of g. To accomplish this, substitute r/R=B/t into g=a sin(r/R), thus B=t sin(g). A series of vector rotations in x y z Cartesian coordinates about the common center O illustrated in FIG. 3 can now be performed in a series of steps. First, rotate vector V=[0,0,R] by +B about the x-axis using the right hand rule. Second, rotate this result by +g about the y-axis. Third, rotate this second result by angle "t" about the z-axis. Below are the series of matrix rotations and resulting parametric equation for a spherical involute in Cartesian coordinates:

$$\text{Involute} = \begin{bmatrix} \cos(t) & -\sin(t) & 0 \\ \sin(t) & \cos(t) & 0 \\ 0 & 0 & 1 \end{bmatrix} \begin{bmatrix} \cos(g) & 0 & \sin(g) \\ 0 & 1 & 0 \\ -\sin(g) & 0 & \cos(g) \end{bmatrix} \begin{bmatrix} 1 & 0 & 0 \\ 0 & \cos(B) & -\sin(B) \\ 0 & \sin(B) & \cos(B) \end{bmatrix} \begin{bmatrix} 0 \\ 0 \\ R \end{bmatrix}$$

$$\text{Involute} = \begin{bmatrix} X(t) \\ Y(t) \\ Z(t) \end{bmatrix} = \begin{bmatrix} R\{\sin(t\sin(g))\sin(t) + \cos(t\sin(g))\cos(t)\sin(g)\} \\ R\{\cos(t\sin(g))\sin(g)\sin(t) - \sin(t\sin(g))\cos(t)\} \\ R\{\cos(t\sin(g))\cos(g)\} \end{bmatrix}$$

Where g=a sin(r/R), r being the radius of base circle 26 in FIG. 3 and R being the radius of the spherical plane 30 in which the spherical involute lies.

A spherical involute curve in one form may span the space between two reference points on a sphere of radius R. One simply needs to apply an arbitrary rotation of the spherical involute curve about the z-axis in order to position the spherical involute curve accordingly. The base circle radius may be adjusted to control the "pitch" or slope of the involute curve. The angular position "t" controls the starting and ending points of the involute. A range of t values may be selected to precisely control the end points of the involute curve. There are limitations on the points that can be joined with a spherical involute. For example, end points P of the involute curve cannot lie outside of two base circles inscribed on the sphere, base circles centered on the z-axis and mirrored about the x-y plane. For points that lie between these base circles it is possible to connect some points with a spherical involute curve. One may also satisfy any tangency conditions at both points. For example, referring to FIG. 32, to produce an involute curve surface lobe instead of the lobe shown, a first point could be defined as the location where edge PA27 intersects the spherical plane at one end, and the involute curve could be made to also pass through the point where edge PA29 intersects the spherical plane. One will then discard the rest of the involute curve, using only the segment that connects the two points. Tangency conditions could also be met such that the involute curve smoothly transitions from lobe tip end curves, or smoothly transitions at a root between two lobes.

Figure 4:
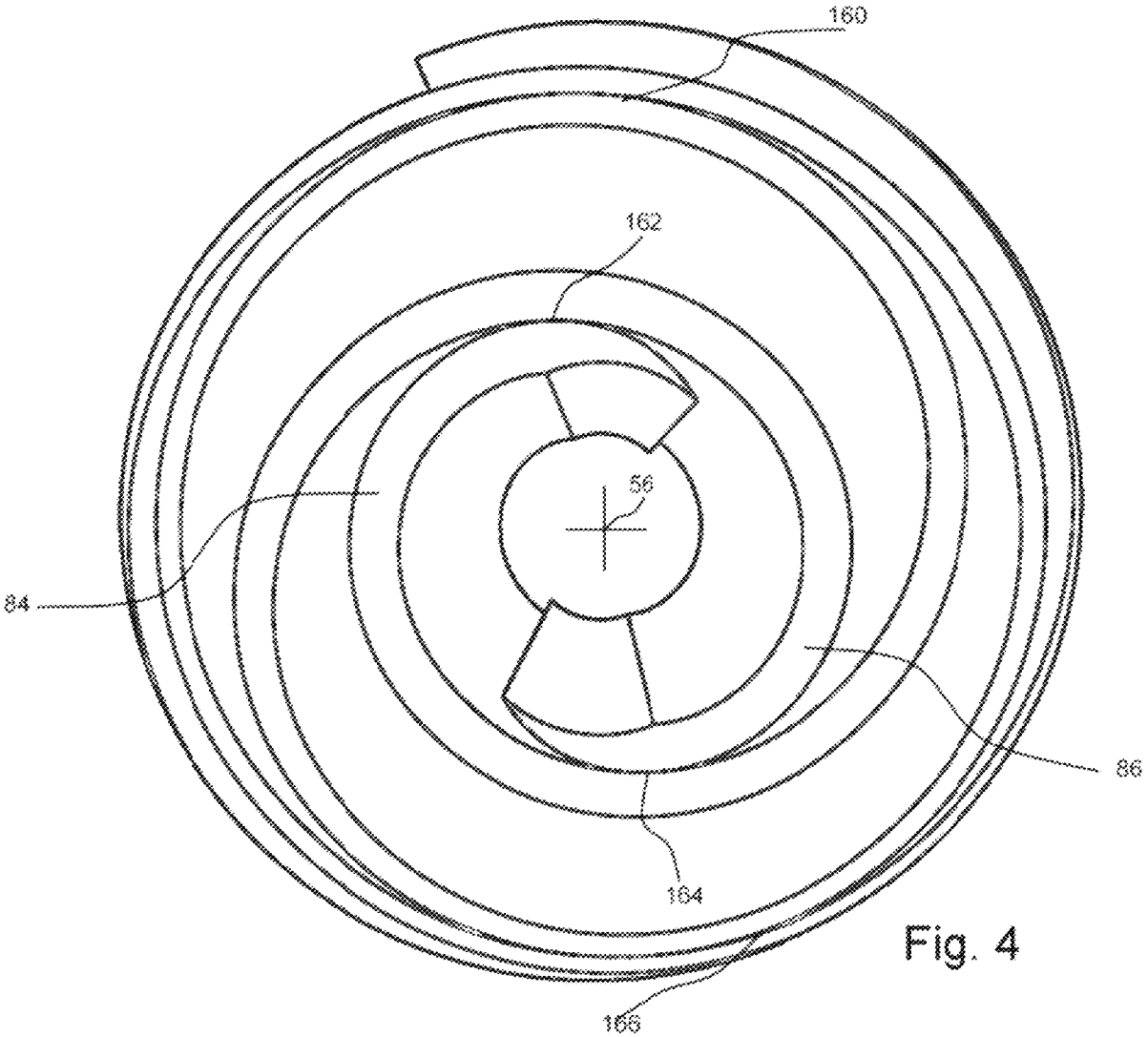
FIGS. 4-6 are depictions of embodiments of surfaces defined by a series of elongate involute curves.
Figure 5:
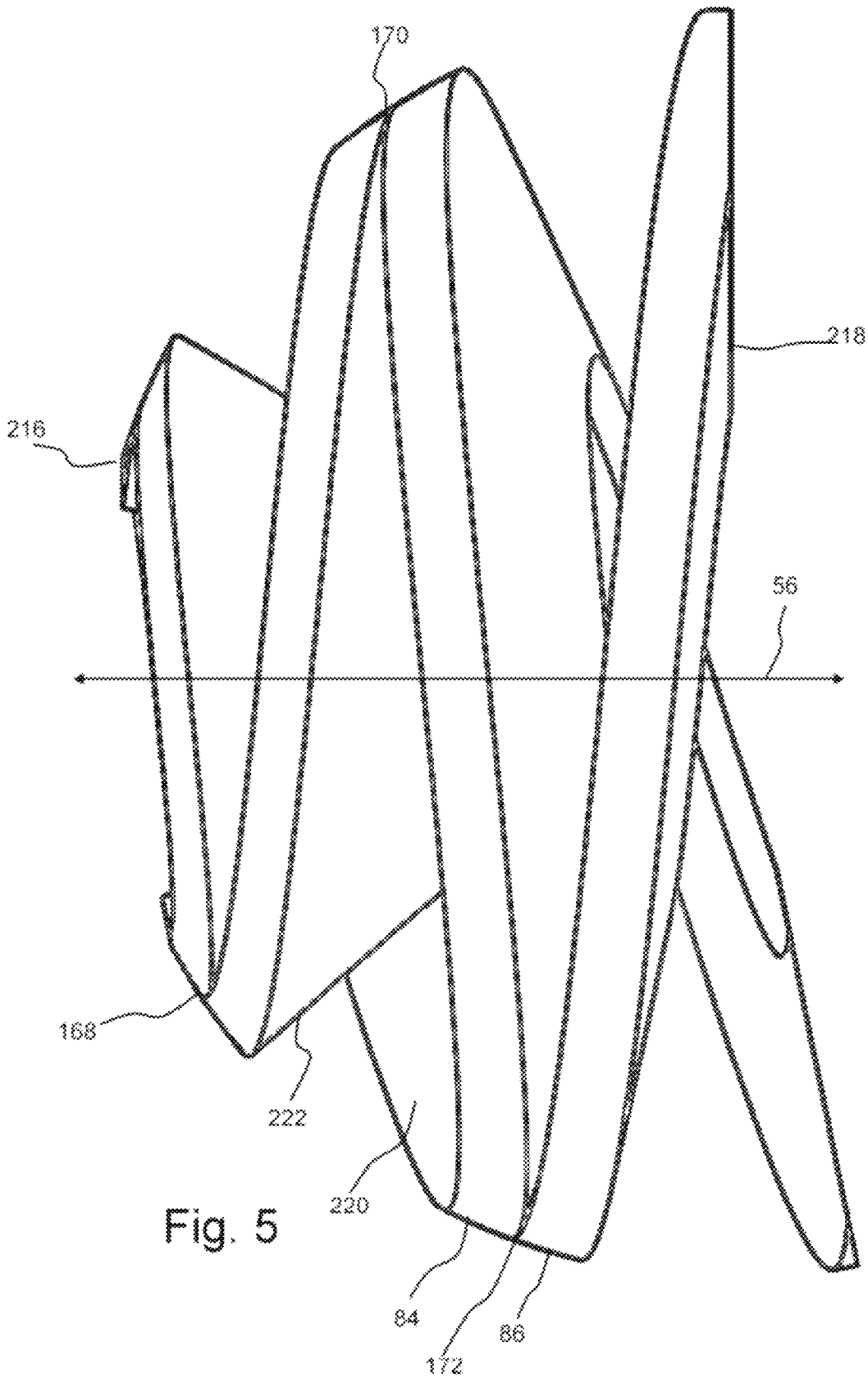
Figure 6:
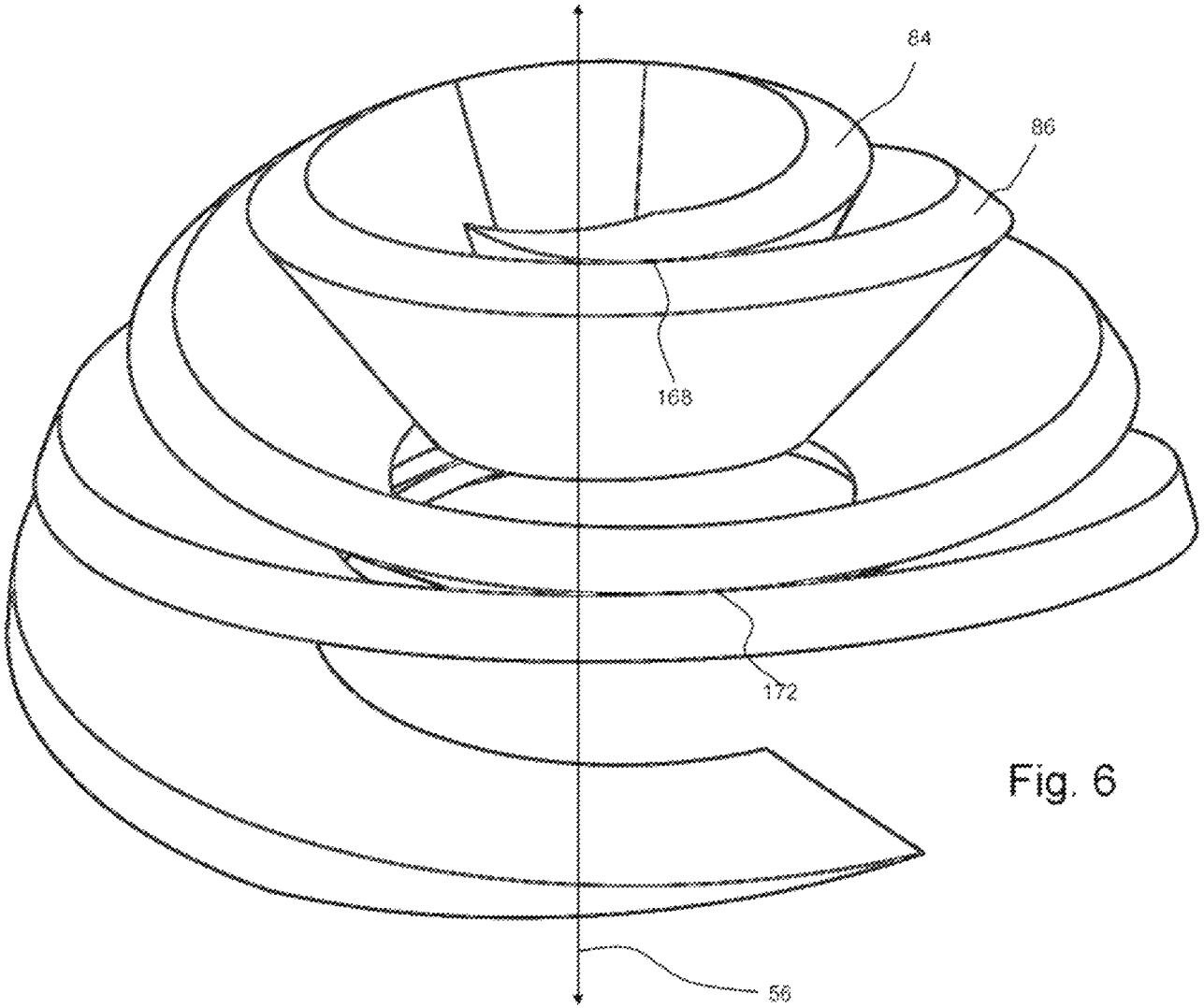
Figure 7:
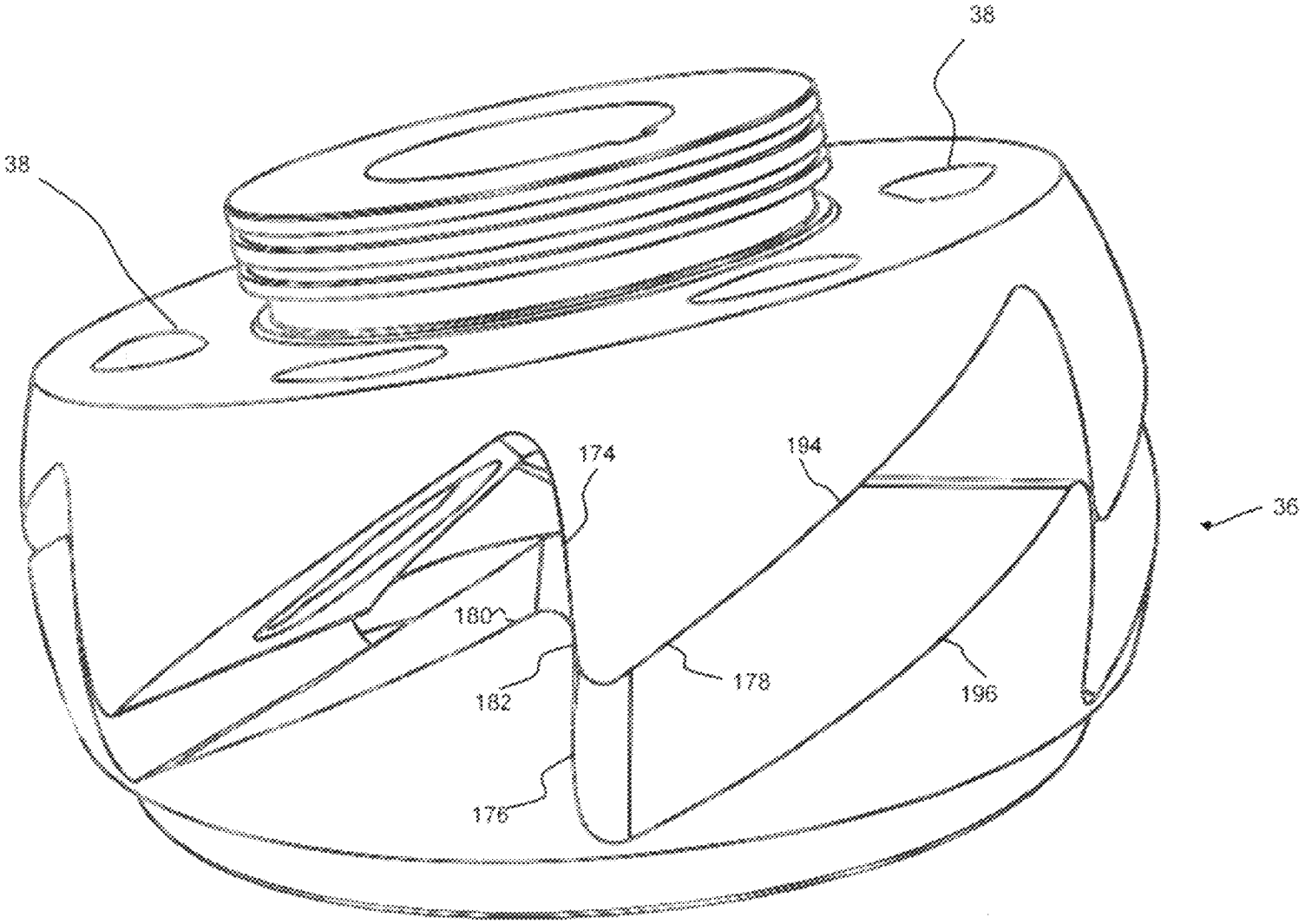
FIG. 7 shows one embodiment of an expander at a point of maximum volume between the rotors.
Figure 10:
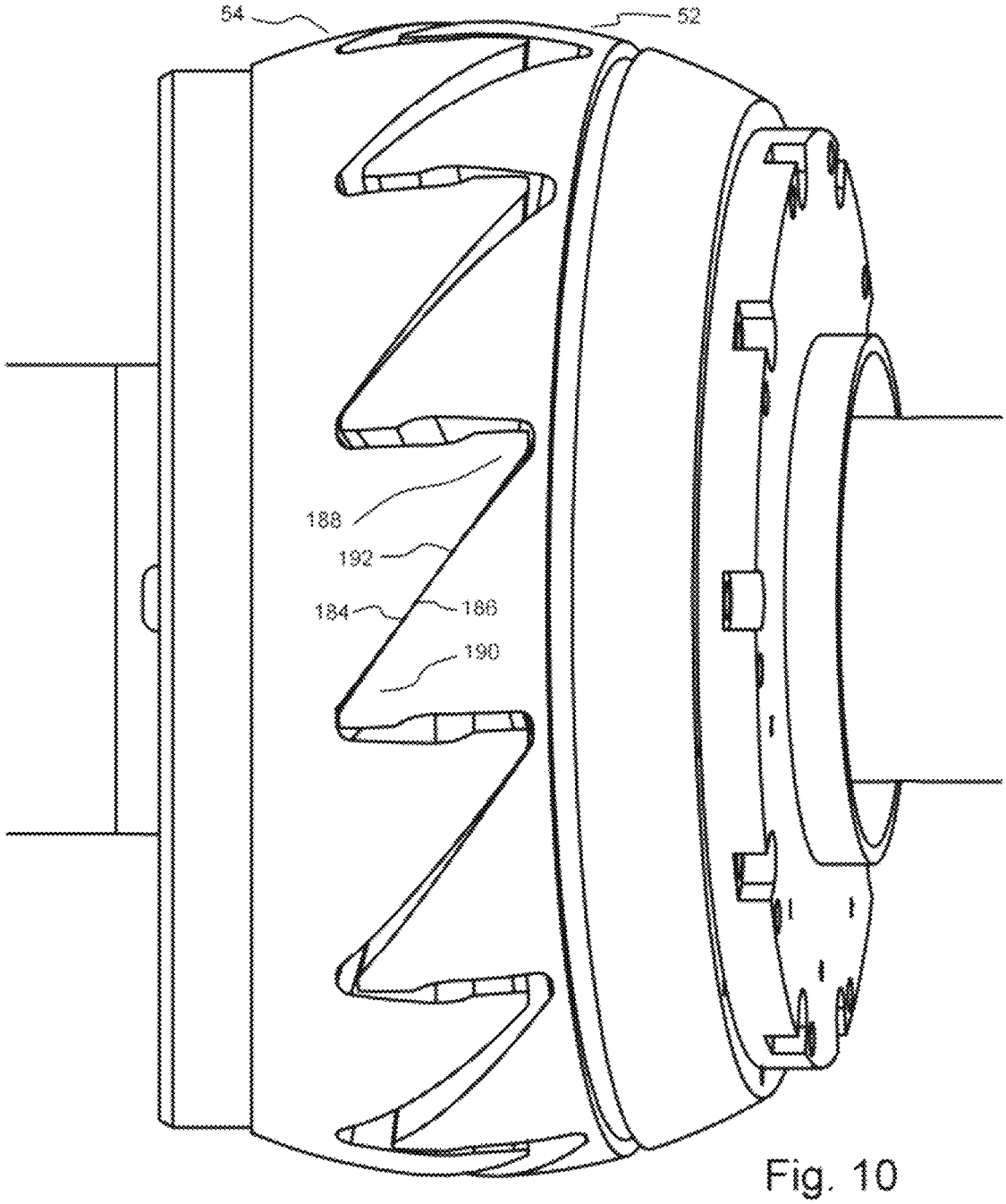
FIG. 10 shows the rotors of FIG. 9 in a minimum volume position.

The use of the spherical involute has been found to allow much improved load transfer between rotors through the improved rolling contact between involute surfaces. In the example of FIG. 4, the rotors are shown contacting at contact points 160, 162, 164, and 166. In FIGS. 5 and 6 the rotors are contacting at points 168, 170, and 172. In the embodiment of FIG. 7, the teardrop surfaces 174 and 176 of the lobes 178 and 180 respectively, are shown contacting at point 182. In this embodiment, point 182 is a rubbing, or frictional contact point, and not a rolling contact point as the rotors rotate about their respective axes. In the embodiment of FIG. 10, the involute curve surfaces 184 and 186 of lobes 188 and 190 respectively are in rolling contact at point 192 as the rotors rotate about their respective axes. The lobes can be designed in such a way that multiple lobes can have involute to involute contact (as shown in FIG. 10), which further increases load carrying capacity. Adding a spiral transformation can further increase the number of lobes that are in contact.

Figure 8:
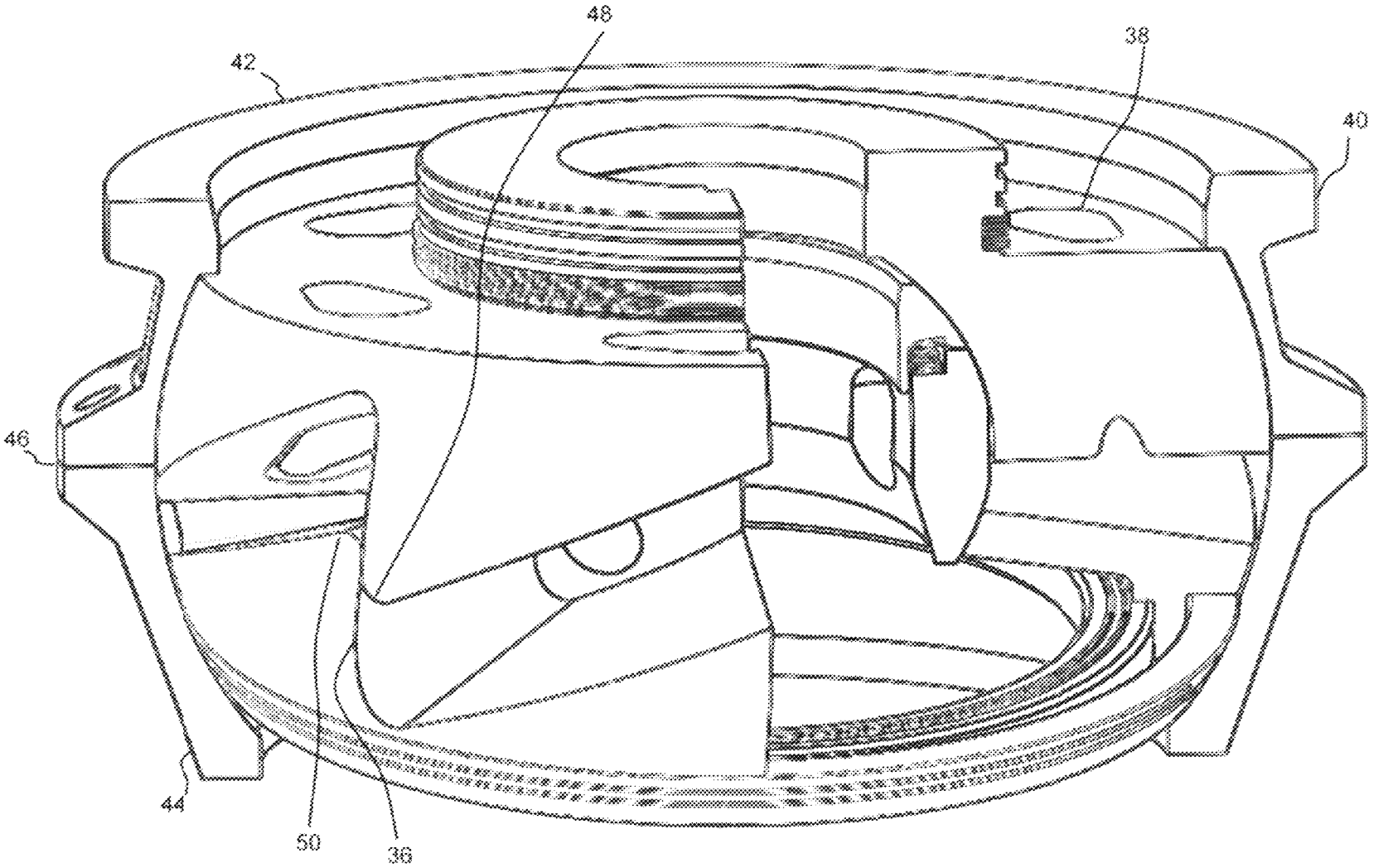
FIG. 8 shows a partial cutaway view of the expander of FIG. 7 within a shroud.

FIGS. 7 and 8 illustrate the use of the involute surfaces 194, 196 in a sawtooth pattern 36 alternating with teardrop geometry surfaces 174, 176, used in this case as a gas expander with rear porting 38 and a shroud 40 which in this embodiment comprises a first section 42 and a second section 44 divided at a split 46. The involute base circle diameters are adjusted to create spherical involutes that are precisely tangent to both the lobe tips 48, 50 which in this embodiment are conical rabbit ears, as well as precise tangency at the roots of the lobes.

Figure 11:
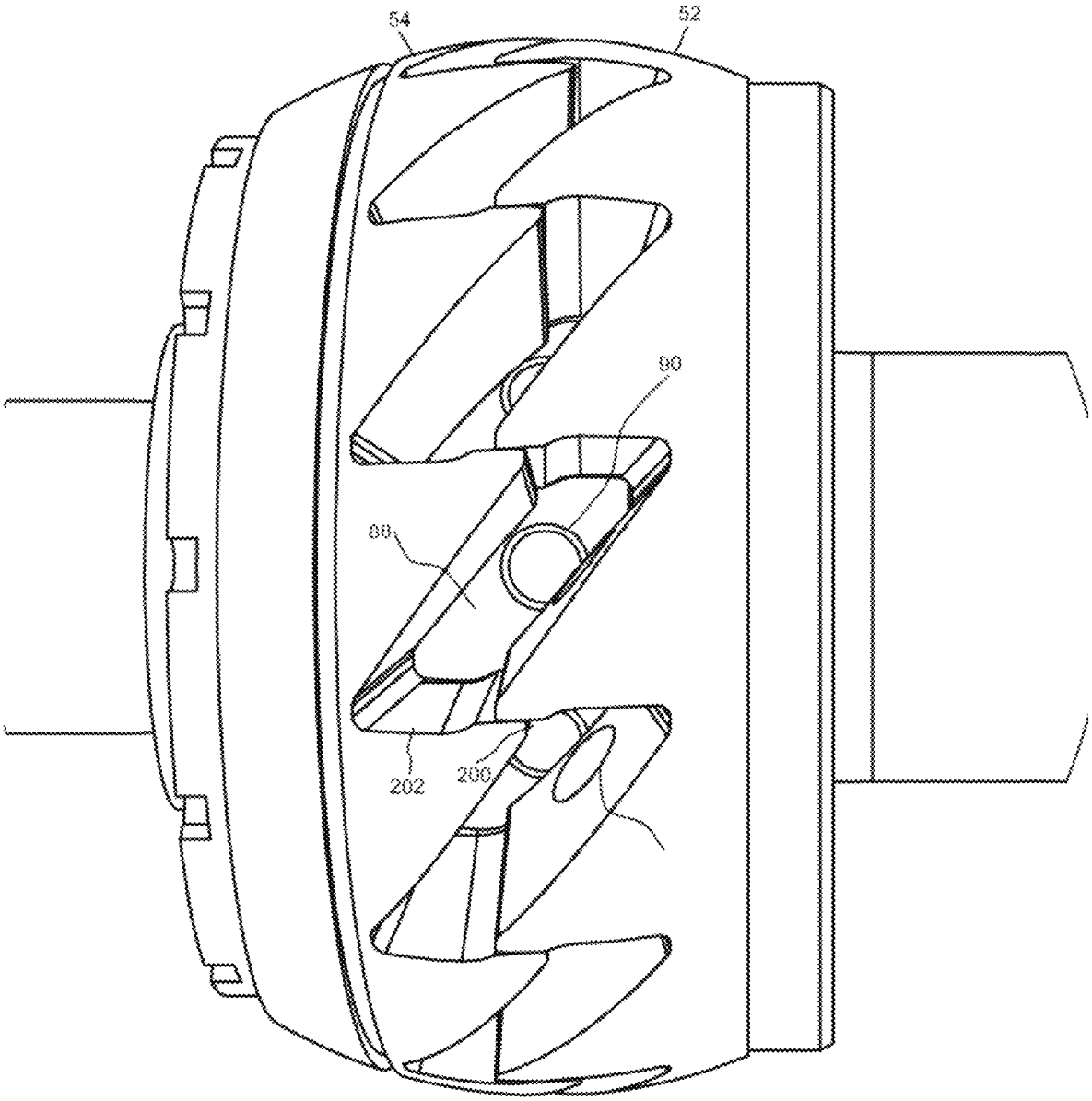
FIG. 11 shows the rotors of FIG. 9 in a maximum volume position.
Figure 12:
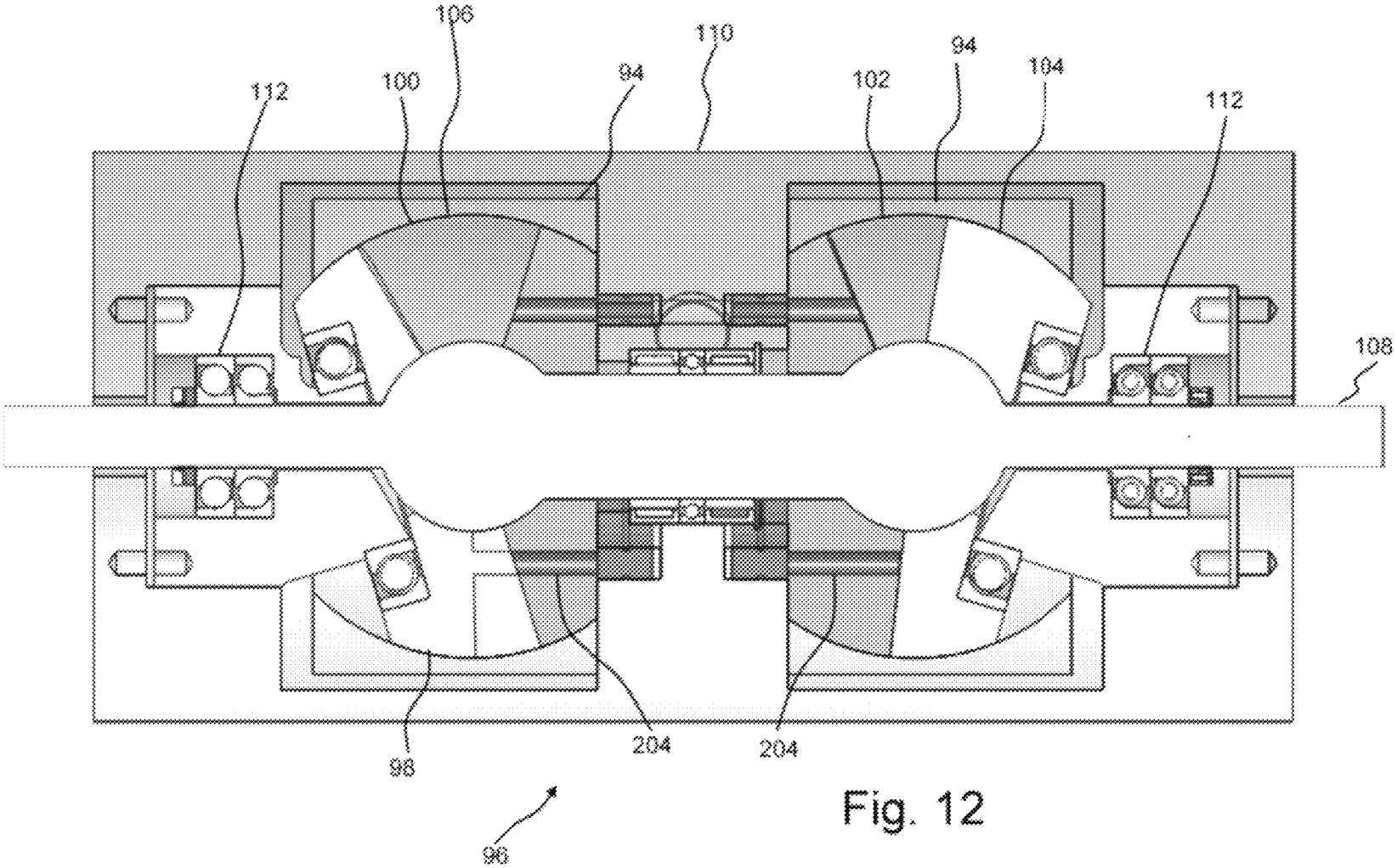
FIG. 12 shows one embodiment of a single lobe involute compressor using two pairs of rotors in a housing.
Figure 33:
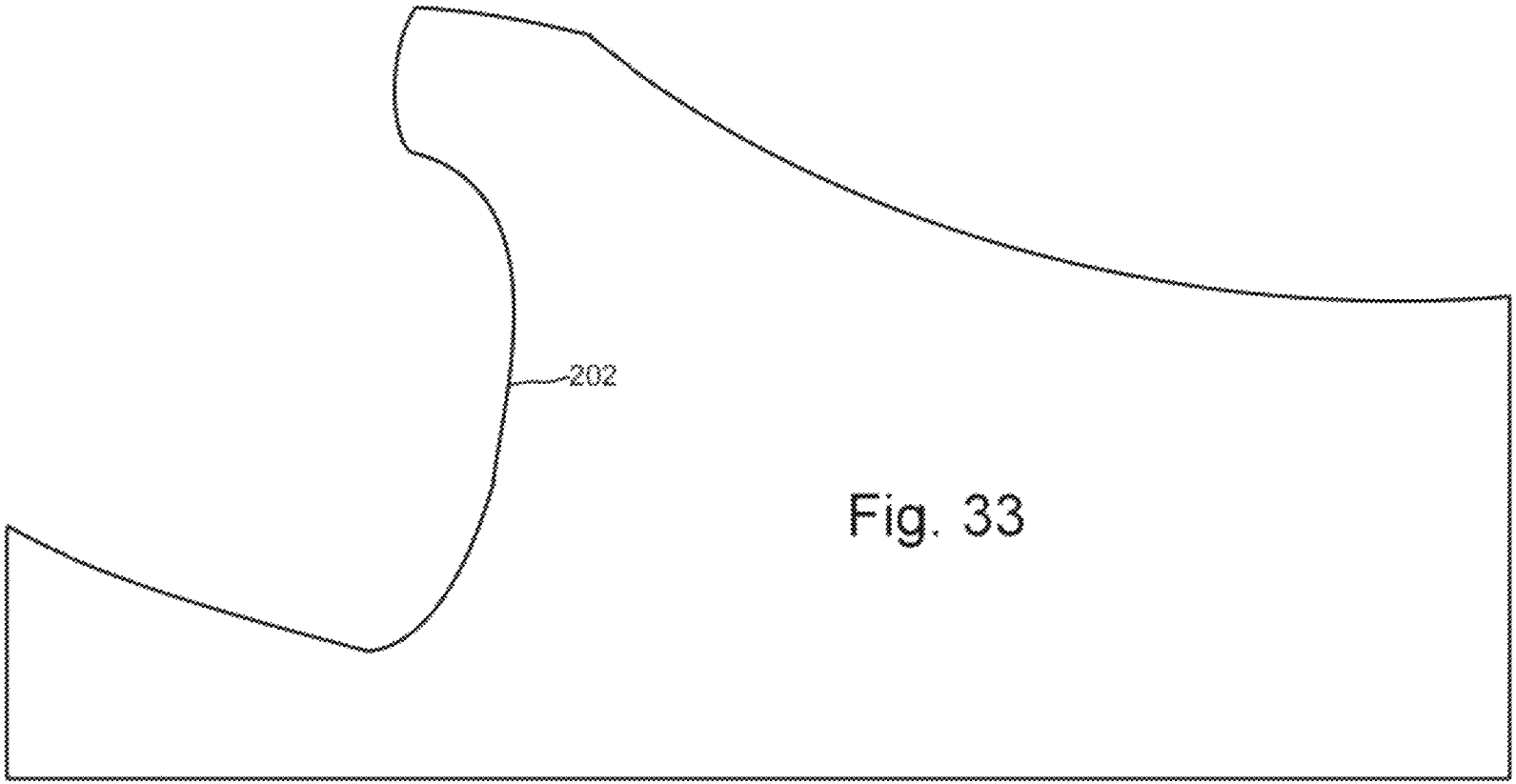
FIG. 33 shows a detail cross sectional view of part of a rotor.

FIGS. 9-11 illustrate the use of the involute curve with rotors 52/54 having shapes similar to teardrop shapes alternating, in a pump rotor embodiment, to be used with a shroud (not shown) and rear porting through surfaces defining ports 198. In FIG. 11 it is also shown some circular flats 90 machined onto the ball 88, to allow for easy assembly of the rotors over the ball. With such flats or recesses, it is not required to "snap" the rotors 52, 54 over the ball 88 and not necessary to have special removable sleeves to allow for the overhang assembly compensation. While circular flats are shown, the machined detents need not be circular, nor need they be flat. The detents provide clearance for the rotors to pass thereby such that the central spherical surface of one rotor contacts the ball 88, and the opposing rotor has a predefined clearance gap or positive seal with ball 88. In these Figs., it is shown that there may be clearance seals formed at minimum volume by the involute-to-involute clearance (which may also be designed as a contact if so desired and optionally for torque transfer), and clearance seal at the lobe tips 92 at the maximum volume position shown in FIG. 11. In this particular embodiment the lobe tips 200 are not constructed from circular or conical tips but rather out of flats, or very thin ovals, whereby the sealing gap is long and thin, providing a better lobe-to-lobe seal as the pressure drop through a long thin gap is greater than a shorter gap of the conical lobe tip type. There are no intermediate sealing required for the lobe-to-lobe seals between min and max volume, hence the "undercuts" 202 that are shown rather than the teardrop profile shown in FIG. 7. This embodiment may be utilized when internal compression is not desired. Since a liquid is relatively incompressible, the device would not operate correctly with internal compression when pumping oil or water for example. FIG. 33 shows one example of such an undercut 202.

Figure 13:
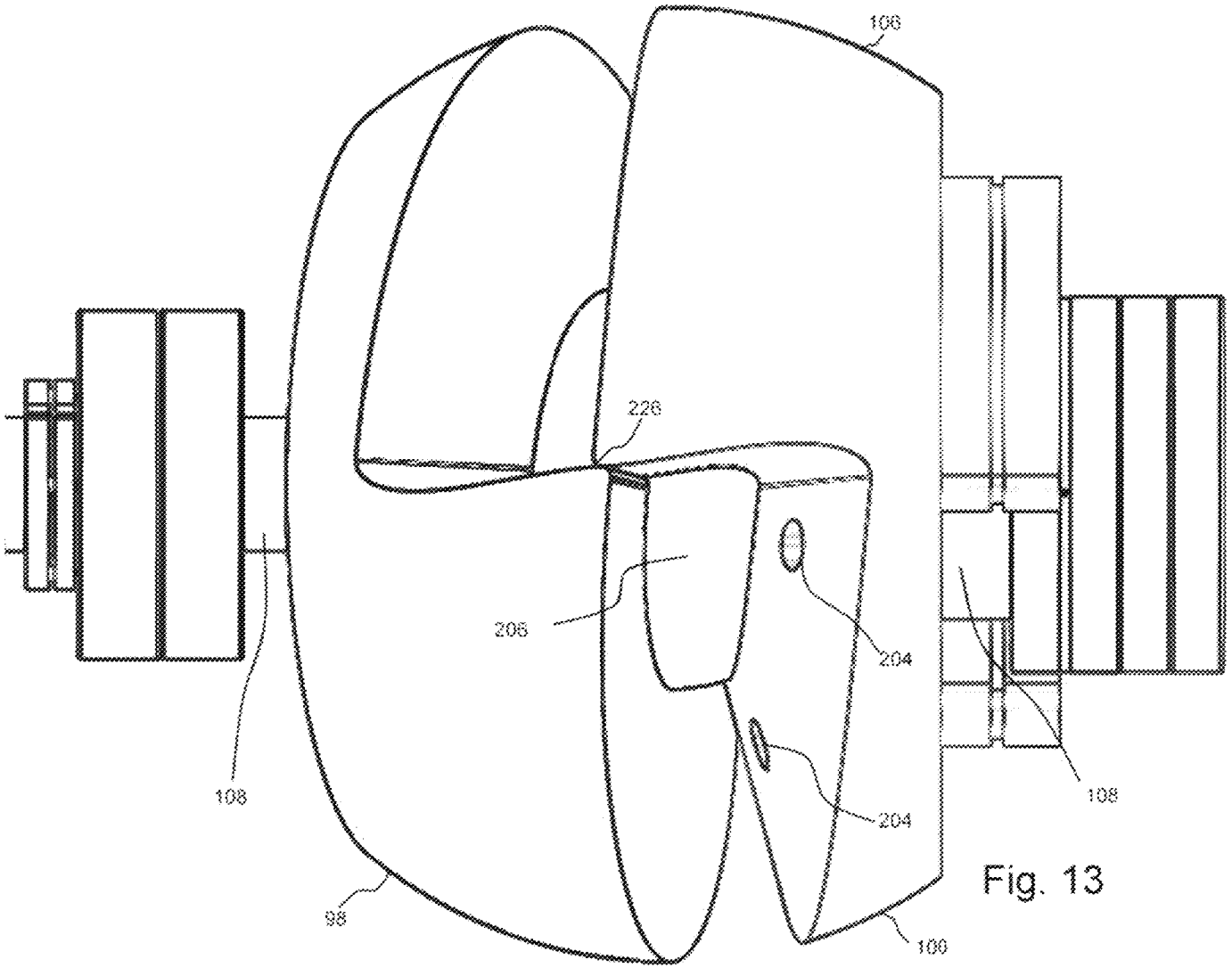
FIG. 13 shows one embodiment of a single lobe involute compressor at a point of maximum volume.
Figure 14:
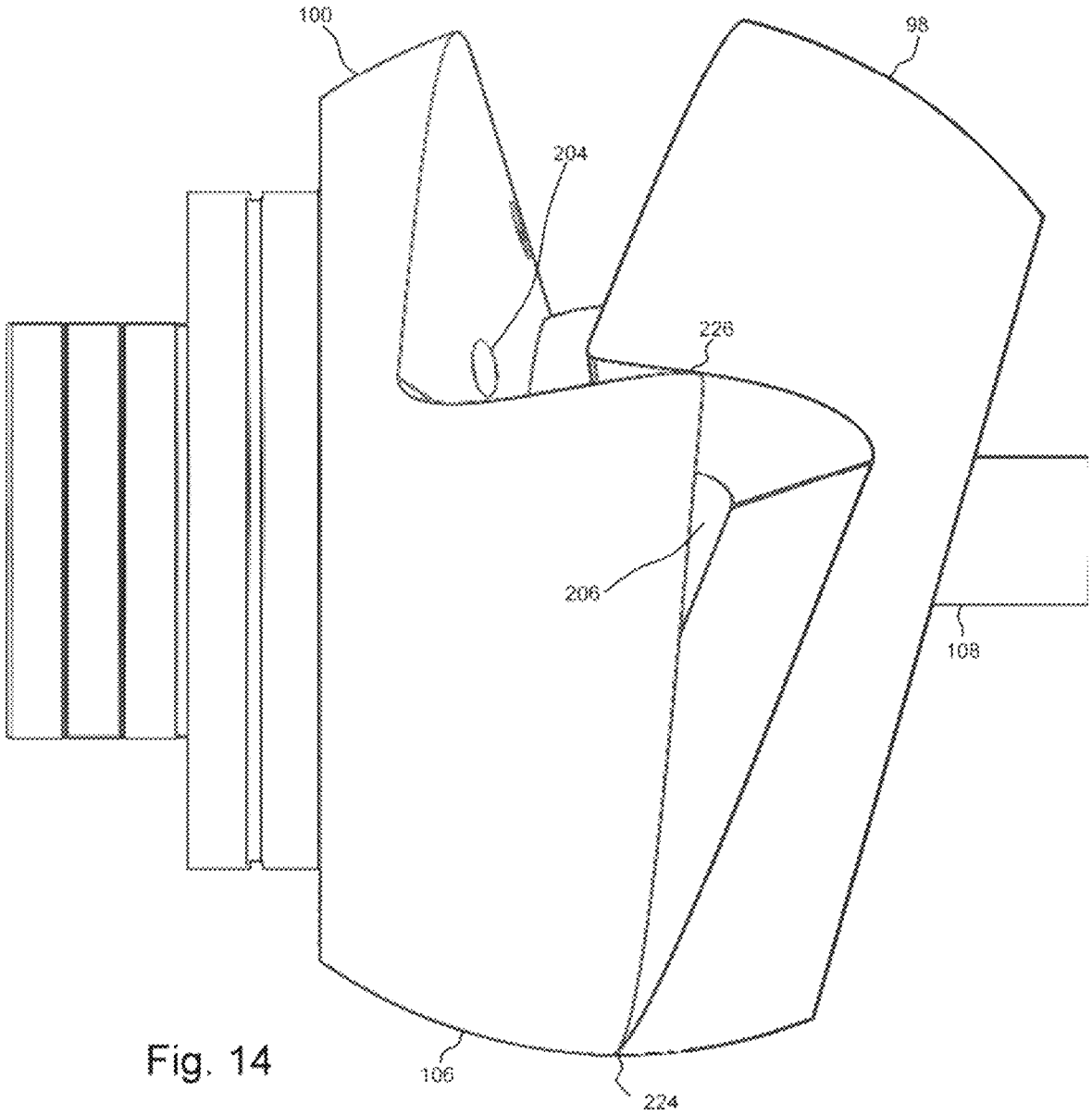
FIG. 14 shows one embodiment of a single lobe involute compressor near the point of maximum volume.
Figure 15:
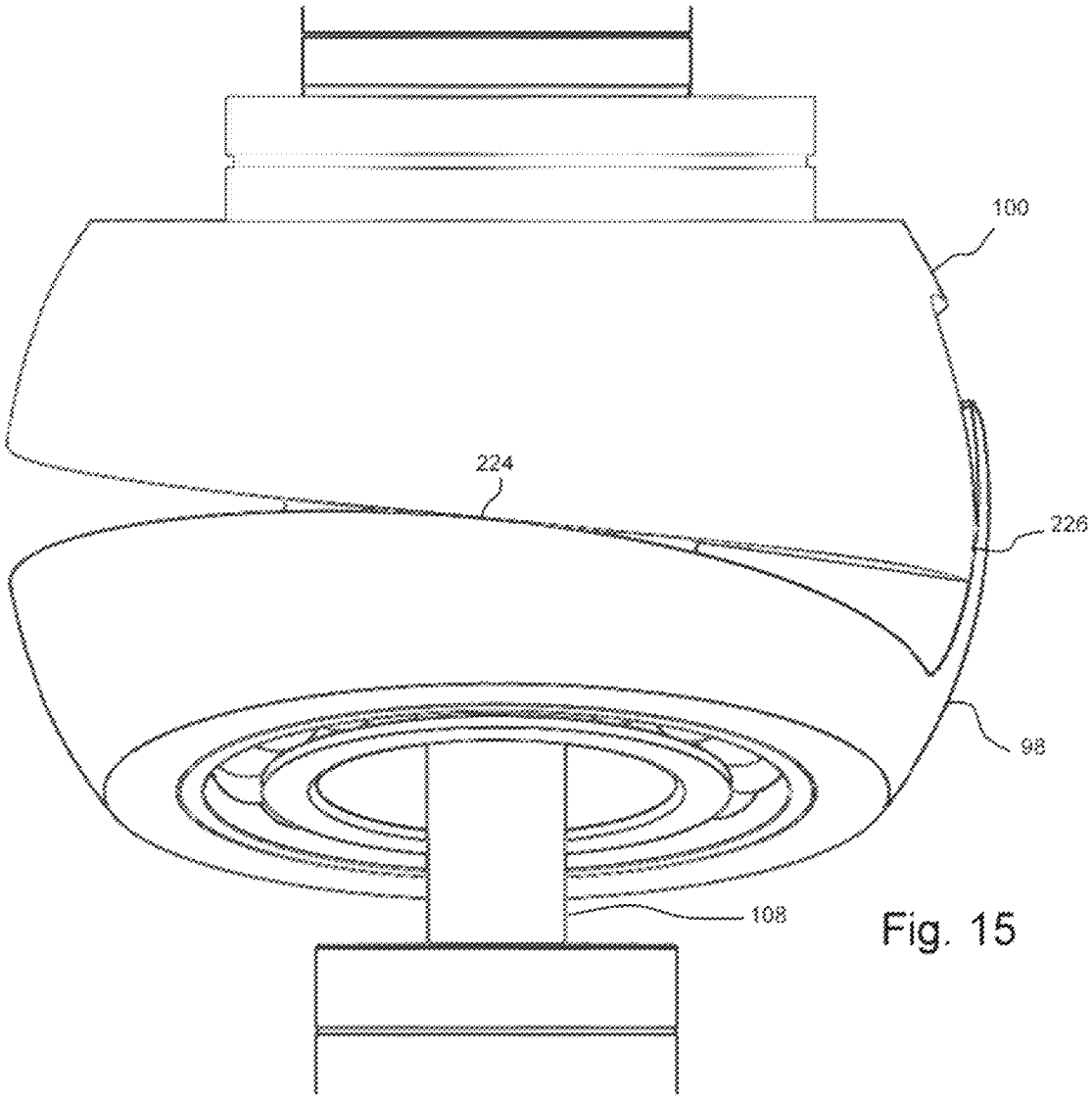
FIG. 15 shows one embodiment of a single lobe involute compressor of FIG. 14 from another viewing angle.
Figure 16:
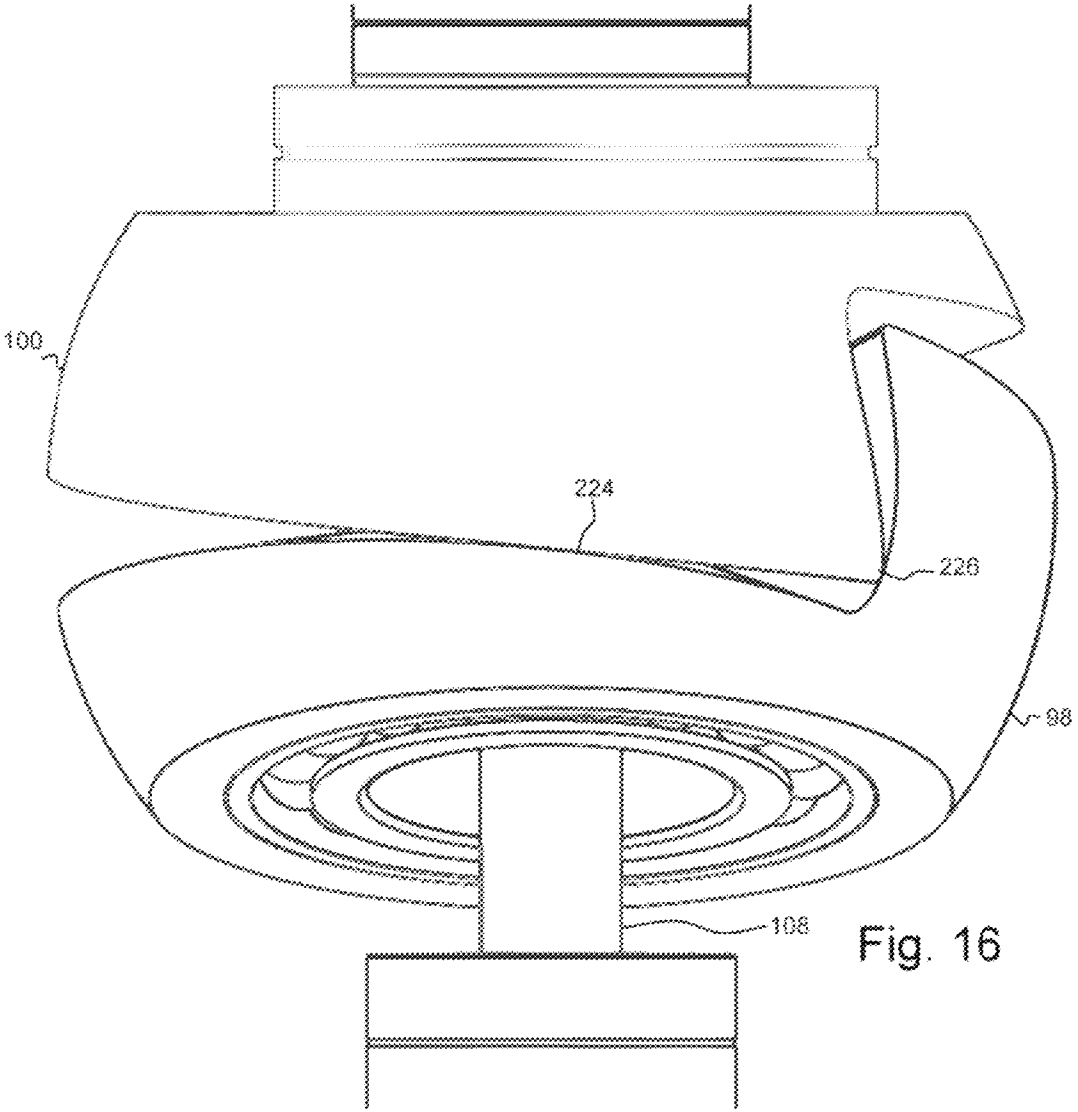
FIG. 16 shows one embodiment of a single lobe involute compressor near a point of minimum volume.
Figure 17:
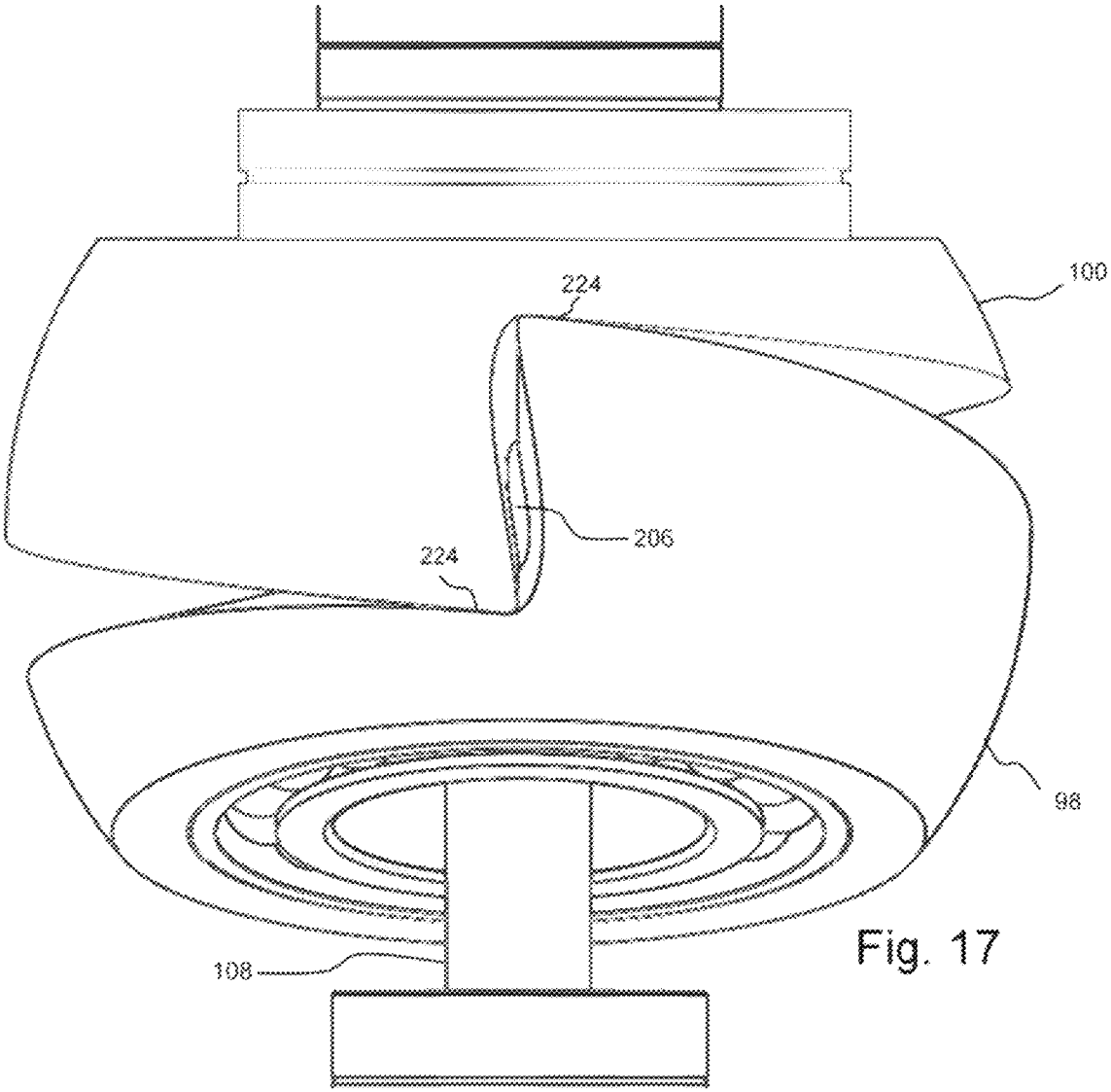
FIG. 17 shows one embodiment of a single lobe involute compressor substantially at a point of minimum volume.
Figure 18:
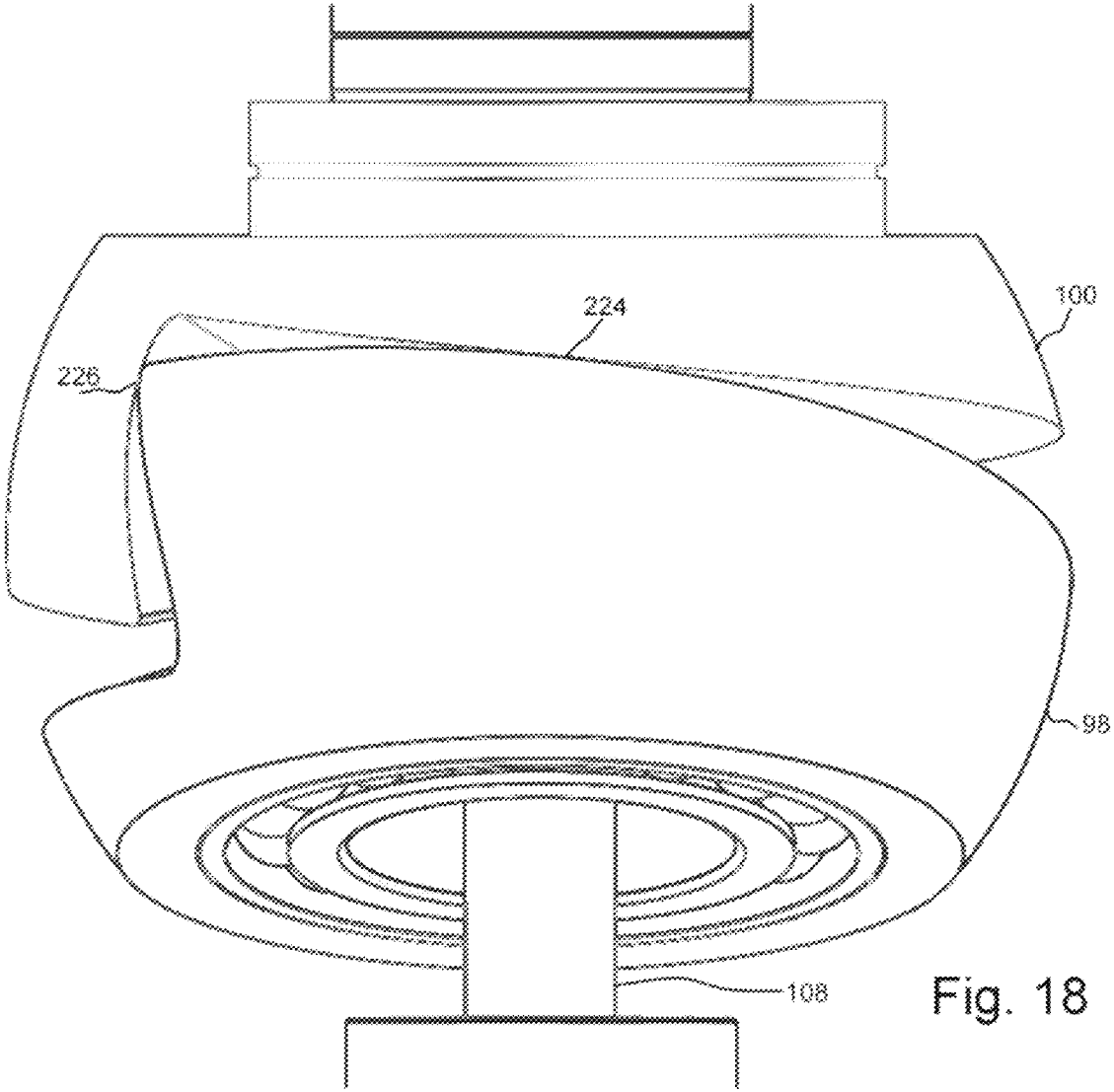
FIG. 18 shows one embodiment of a single lobe involute compressor near a point of minimum volume.

FIGS. 12-18 illustrate an example of a single-lobe spherical involute energy conversion device 96 that could be used to convert energy. This embodiment in one form can be rear ported through surfaces defining voids 204. In one form, a shroud 94 may be utilized. This embodiment has useful advantages, such as having almost zero recirculated (or clearance) volume at the point of minimum volume as shown in FIG. 17, resulting in extremely high compression ratio if desired. FIG. 13 shows a point of maximum volume during rotation, and FIGS. 14, 15, and 18 show points of intermediate volume during rotation. The rotors 98/100 in this embodiment are not necessarily rotationally balanced, but could easily be balanced by removing material around the outside diameter 106 of the rotors appropriately.

In this embodiment, two pairs of rotors 98/100 and 102/104 are shown attached to a single shaft 108 within a housing 110 which may comprise a ball portion 206 similar to that previously disclosed. Bearing sets 112 may be used to properly align the shaft, and to reduce friction between the shaft and the housing.

As shown, there is a point 224 of substantially rolling contact between the axial surfaces of the rotors, and a point 226 of substantially sliding, contact when the radial surfaces of the rotors contact as shown for example in FIG. 18.

FIGS. 13-18 show a rotor assembly comprising a first rotor 98 and a second rotor 100. The first rotor has a first axis of rotation about the shaft 108, with an engagement spherical curve positioned in a spherical plane where the first rotor's engagement curve is defined by a plurality of points. Each point has an associated position derivative vector indicating a direction of tangency to the first rotor's engagement curve. Relative motion vectors at each point along the first rotor's engagement curve, the relative motion vectors defined as the motion vectors of each point on the first rotor's engagement curve measured with respect to a coordinate system rigidly fixed to the second rotor 100, where the relative motion vectors are dependent on the relative rotational positions of the first rotor with respect to the second rotor.

The second rotor has a center rotation axis about shaft 108 that is offset from co-linear to the axis of the first rotor. The second rotor rotates at a prescribed rotational speed with respect to the first rotor. Furthermore, the second rotor has a second engagement surface with a second set of engagement spherical curves positioned in the spherical planes of the second rotor where the plurality of points forming the second rotor's engagement curve are measured on coordinate system rigidly fixed to the second rotor. Each point of this plurality of points corresponds to a specific rotational position of the two rotors. Each point created at the geometric location where one of the first rotor curve position derivate vectors is co-linear with one of the first rotor curve relative motion vectors, where the first and second rotor curves lie on equal diameter spherical planes, and further where the coordinates of the position derivative vectors and the relative motion vectors are the same defines a reference point and the locus of these points on any given spherical plane determines the second rotor's engagement curves on a spherical plane shared by the two rotors. This construct defines a teardrop surface 244 on each rotor, such that contact between the rotors at the teardrop surface has substantially zero clearance. In the single lobe embodiment of these Figs. In this embodiment, an involute curve surface 246 connects the base 248 of a teardrop surface 244 of the lobe to the tip 226 of the lobe.

In more simple terms, in one embodiment, as the tip of one rotor rotates about an axis that is offset from collinear from an axis of an opposing rotor, the lobe tips of the first rotor scribe a teardrop shape in the opposing rotor in the case of FIGS. 13-18, however depending on the location of the lobe tip and shape of the lobe tips, the scribed shape may not be a teardrop, but rather a more oval shape or other shape which results from the mathematics described in the previous paragraphs.

Figure 19B:
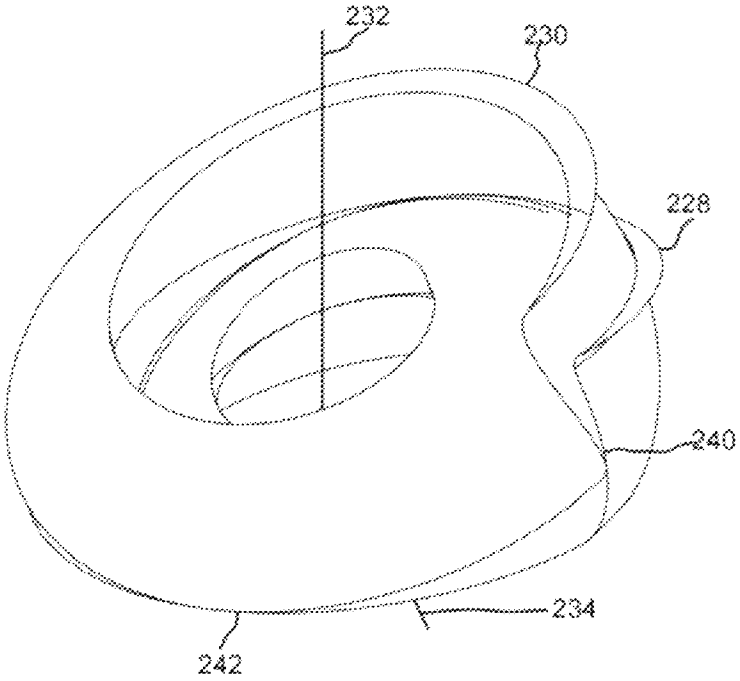
FIGS. 19A-19B show one embodiment of a spiral involute single lobe teardrop rotor.
Figure 19:
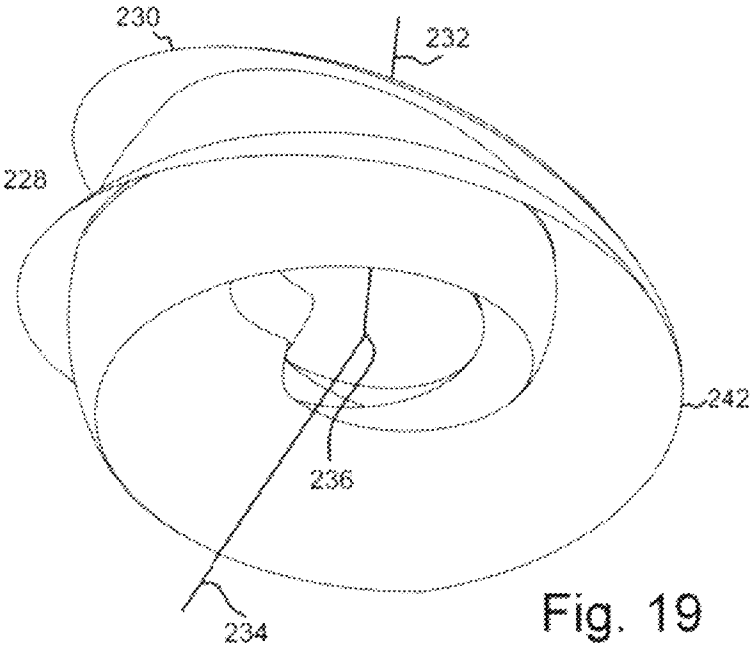

A spiral transformation could be applied to the surfaces to create a radial flow device, such as the device shown in FIGS. 19, and 19B. In this embodiment, each rotor 228, 230 rotates about an axis 232, 234 respectively, and the axes are not collinear, not coplanar, and commonly intersect at a point 236. As with the previous embodiment, the rotors contact at moving points 240 and 242, where contact at point 240 is substantially a frictional contact, and contact at point 242 is substantially a rolling contact.

Figure 20:
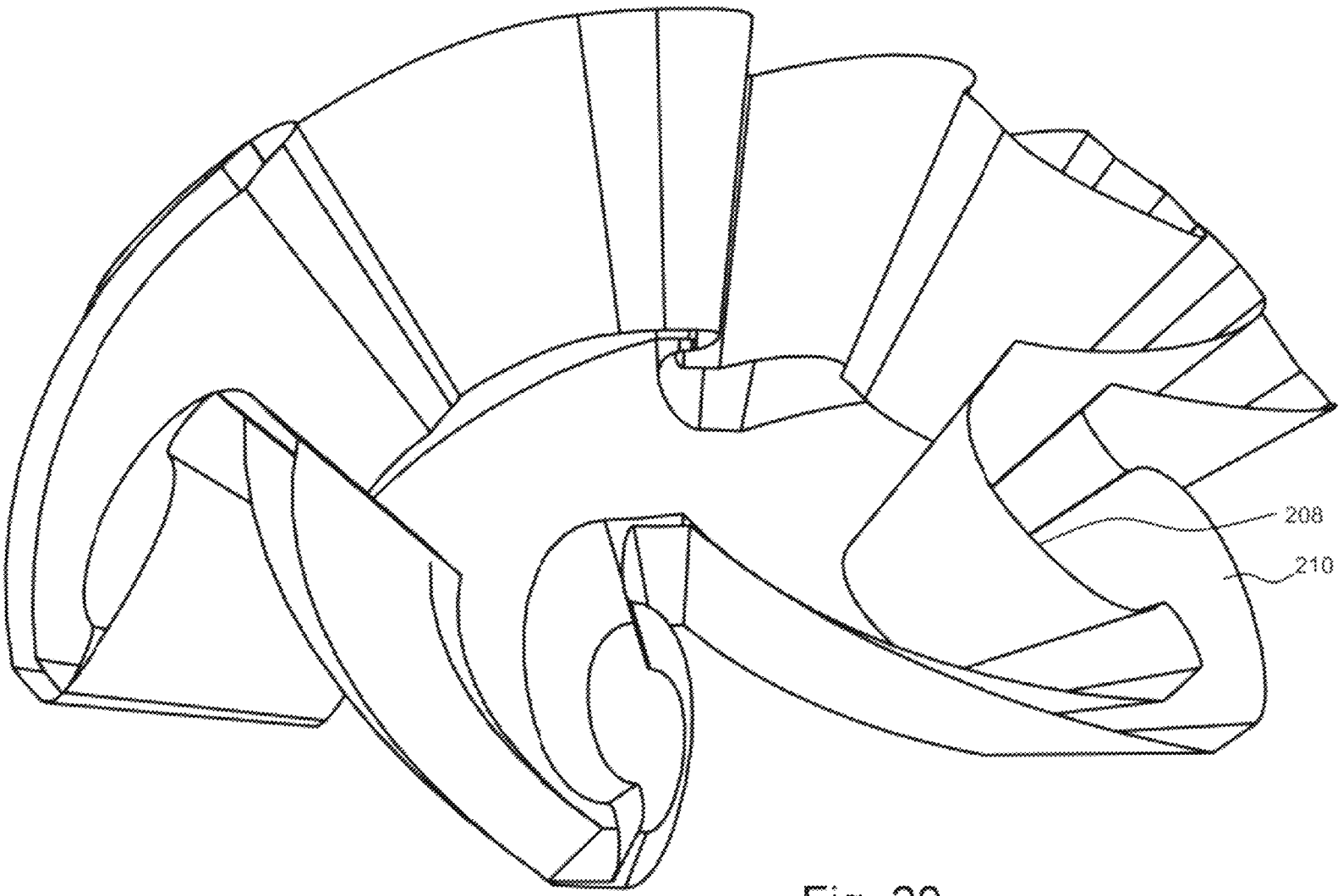
FIG. 20 shows surfaces of one embodiment of a six-tooth oval ear involute sawtooth rotor assembly.
Figure 21:
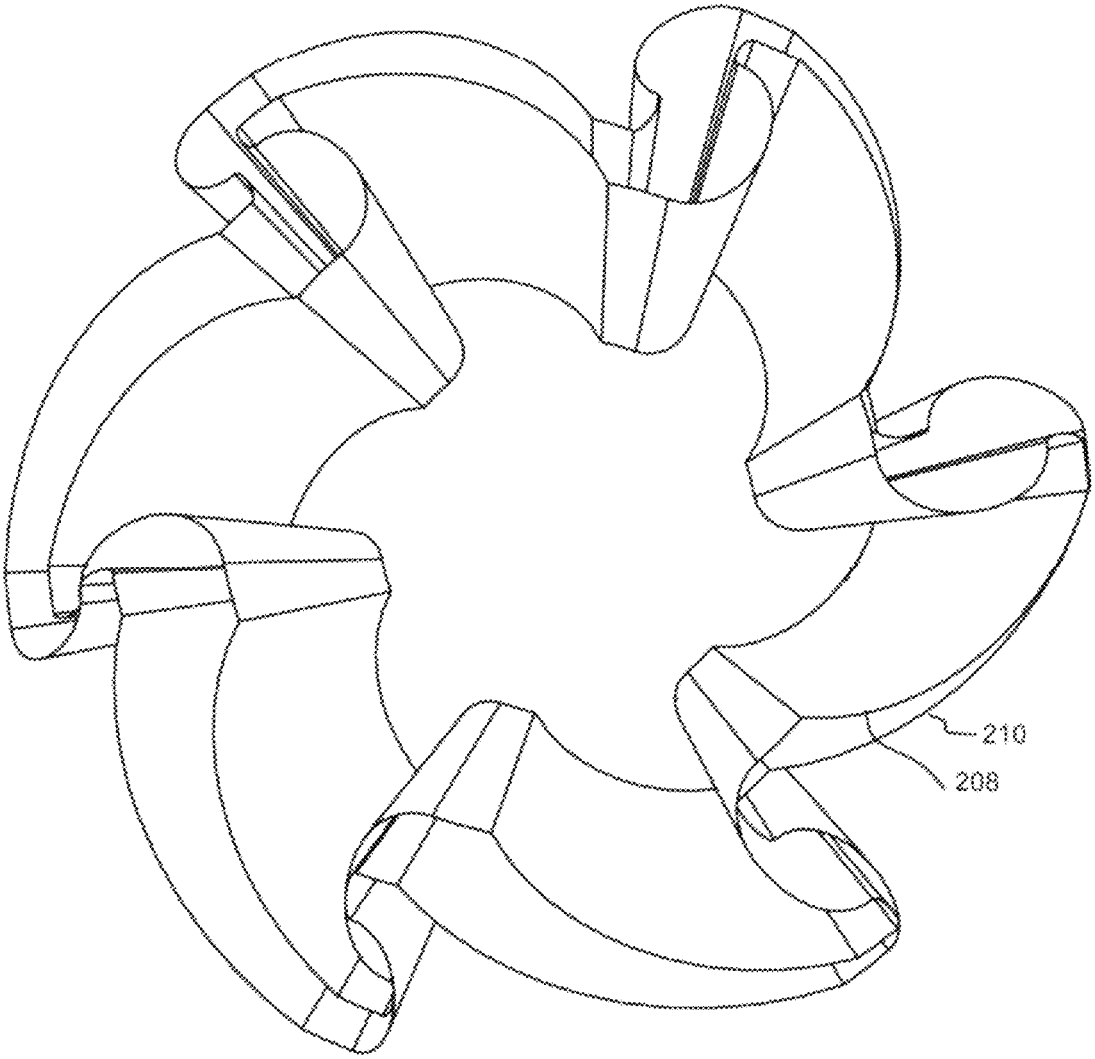
FIG. 21 is a front view of the example shown in FIG. 20.
Figures 22, 22B:
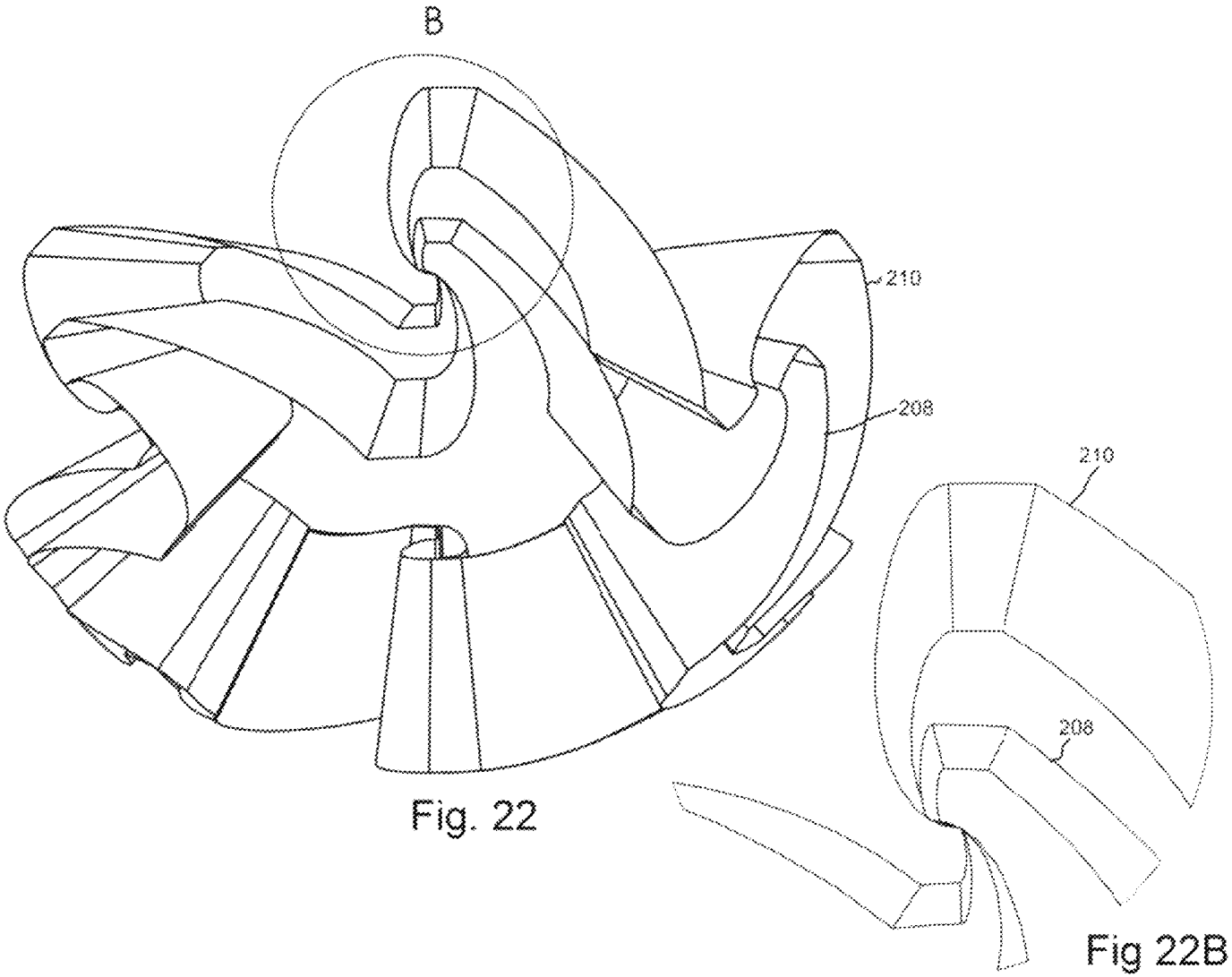
FIG. 22 is a side view of the example shown in FIG. 20.
FIG. 22B shows a detail view of the area B of FIG. 22

There is shown surfaces offset away from the bifurcation plane, and illustrate the spherical involute used in conjunction with oval surfaces, whereby half of the lobes are now involutes, and the lobe tips are formed using very thin ovals. The thin long oval tips allows for a thicker lobe, adding extra strength. FIGS. 20, 21, and 22 show lobes having flat, oval rabbit ears. The resultant lobes are relatively thick as a result of the flat rabbit ear design.

The surfaces 208, 210 illustrated in FIG. 20 could be used for a compressor or expander or other energy conversion devices, with or without a shroud and could have the lobes rear ported as well. However, one could also use these surfaces to form the geometry of timing gears or "indexers" with a controlled backlash. For example, the embodiment shown in FIG. 20 could be for example a direct replacement for the indexers shown in the '674 patent application FIG. 13 items 132 and 158, since the embodiment shown in one form operates at a 1:1 speed ratio. An additional spiral transformation could be applied to the design shown in FIG. 20 much like in the '674 patent application's FIGS. 68A-68C to improve smooth running operation. Note that an indexer such as this could also serve a dual purpose, for example, since it would likely run with oil lubrication, it could also serve as an oil pump, or a secondary energy conversion device.

In gearing, when the direction of load of the driving gear is reversed, backlash is often described as the clearance gap that exists between two sets of gear teeth that must become closed before the force from the reversed driving gear is experienced by the driven gear. It is also referred to as the lash or play. For timing gears in machines that require very accurate motion it is important that the backlash be minimal. Backlash can be designed for a specific clearance gap, or utilizes split gears and springs, a zero backlash with a preload can be accomplished as well.

Figure 23:
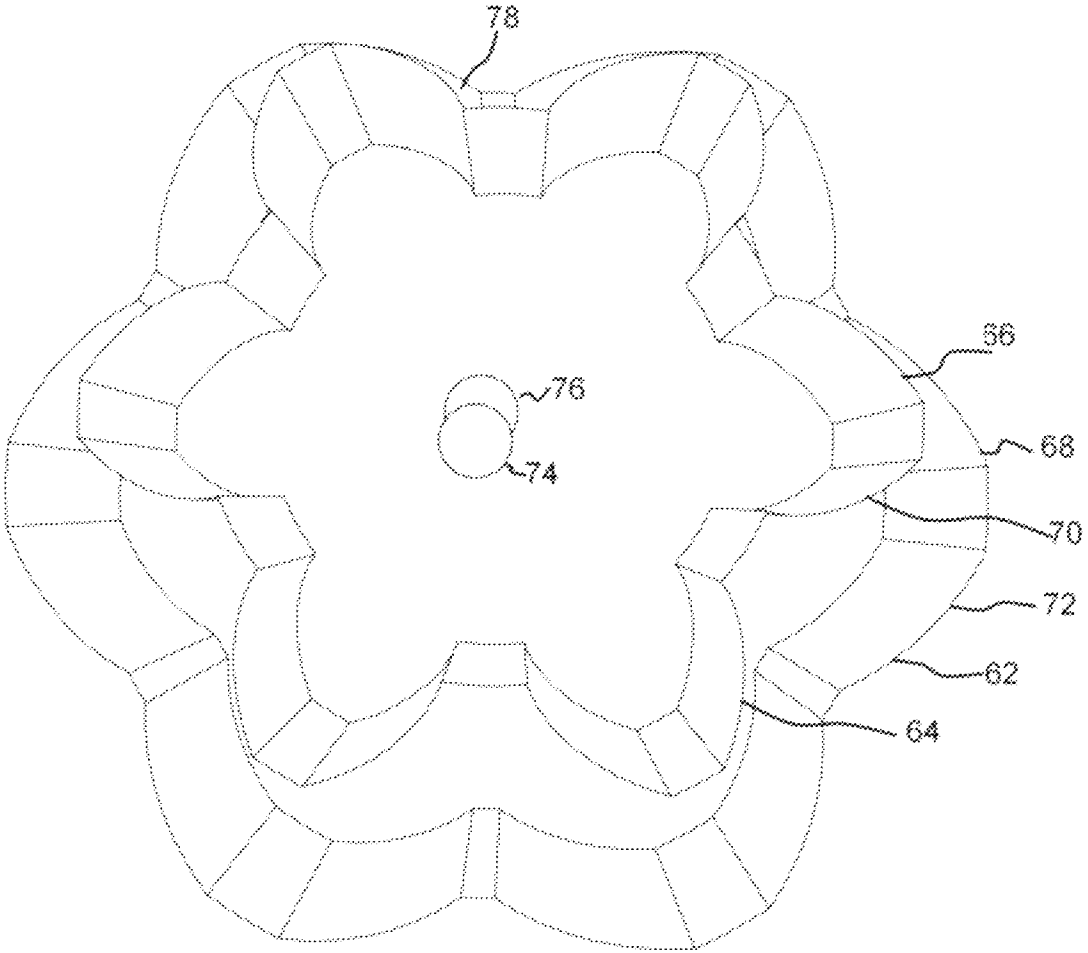
FIG. 23 shows the engagement surfaces of an embodiment of timing gears that may be designed for minimal backlash.
Figure 24B:
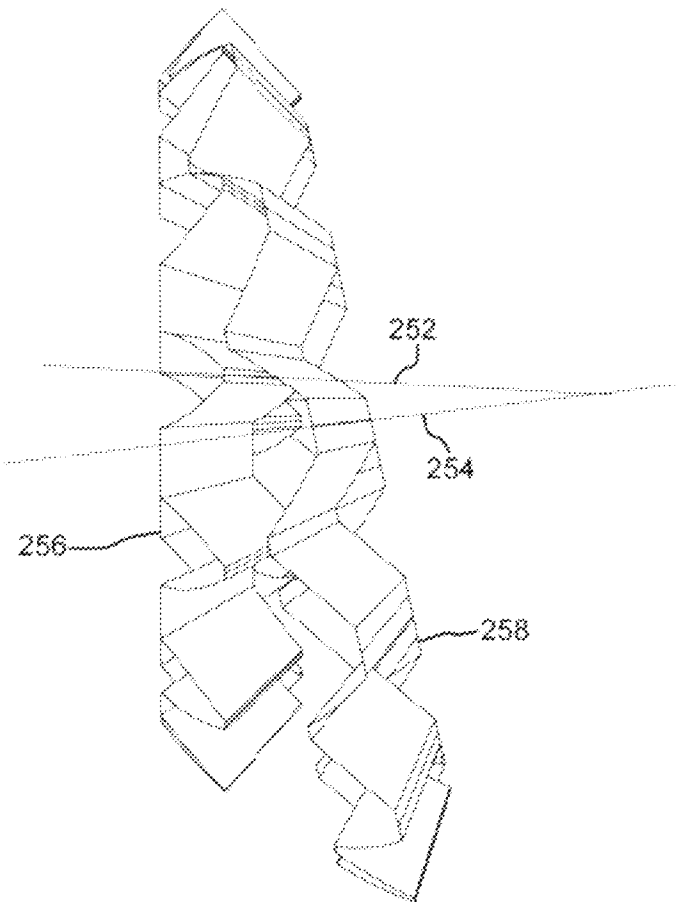
FIG. 24B shows a side view of the embodiments of FIG. 24.
Figure 24:
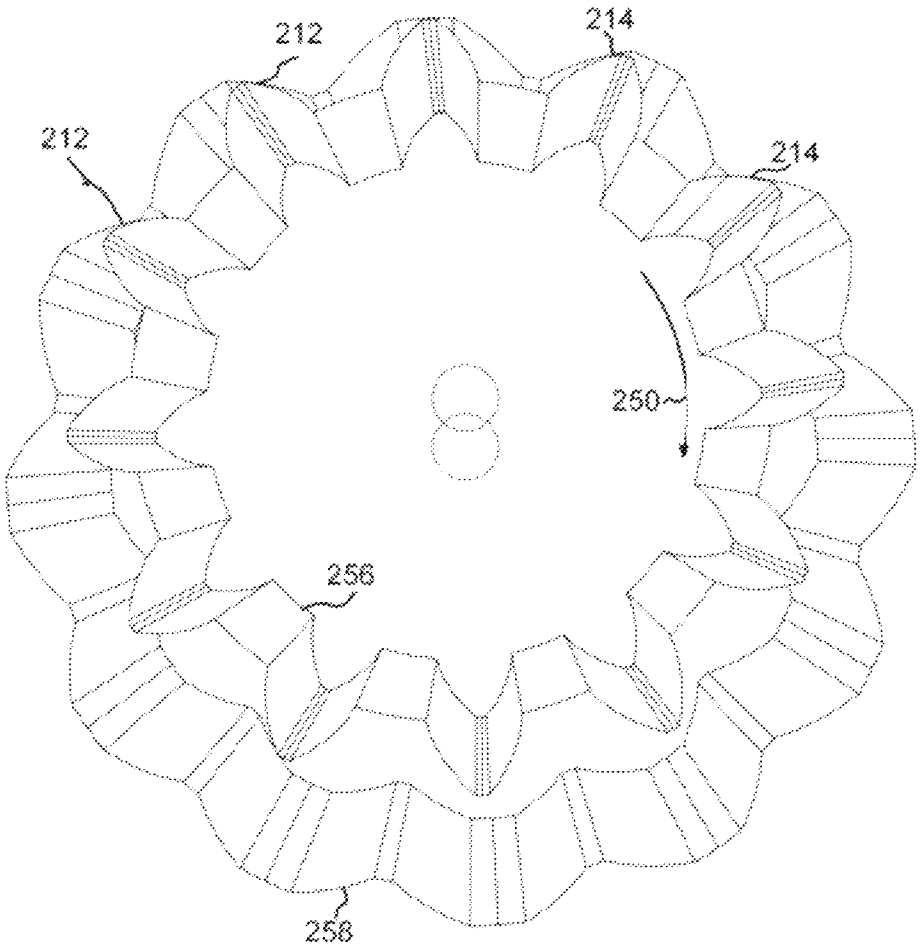
FIG. 24 shows the engagement surfaces of a twelve-lobe embodiment of timing gears that may be designed for minimal backlash.
Figure 25:
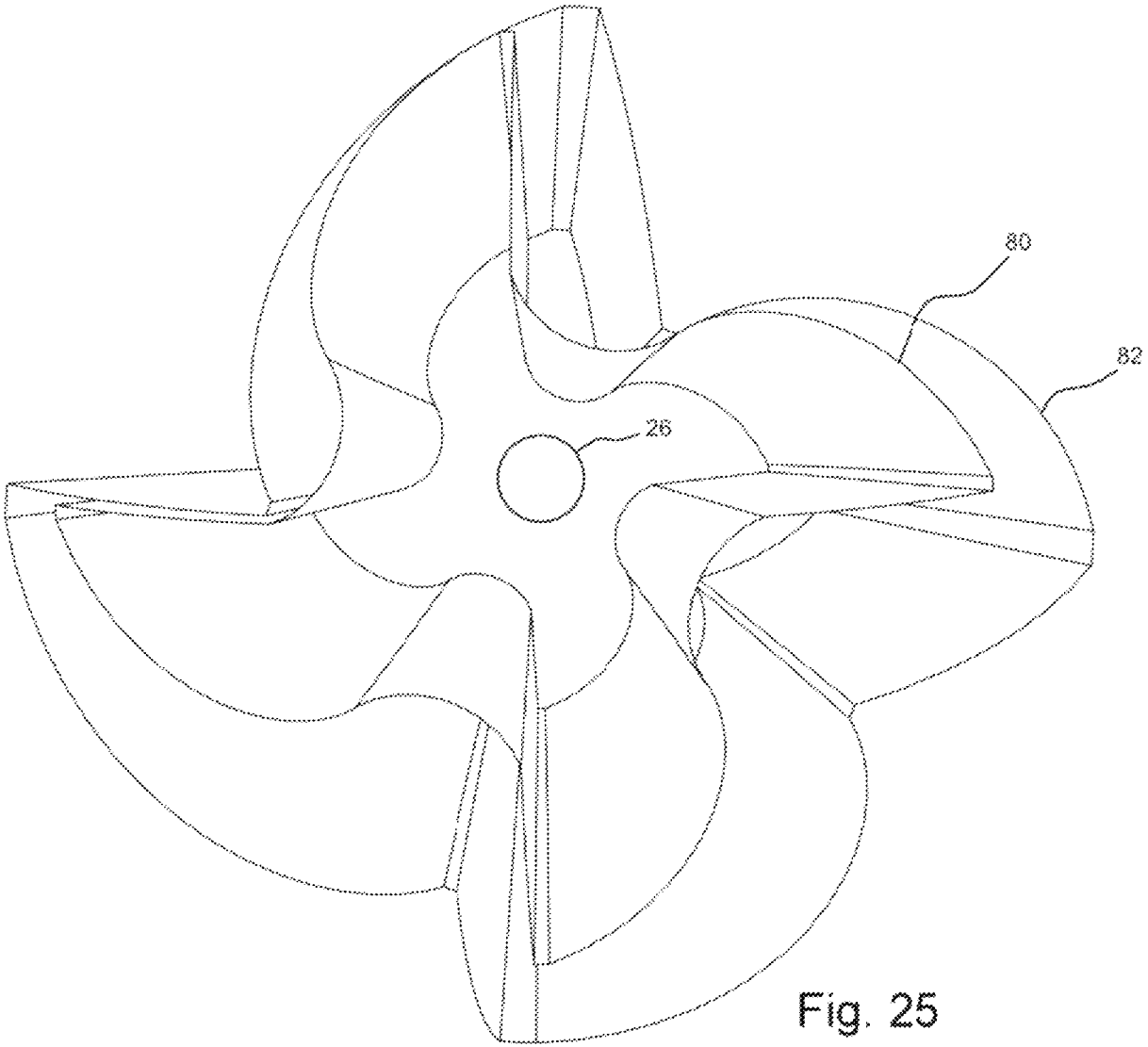
FIG. 25 shows the surfaces of a four lobe embodiment.
Figure 25B:
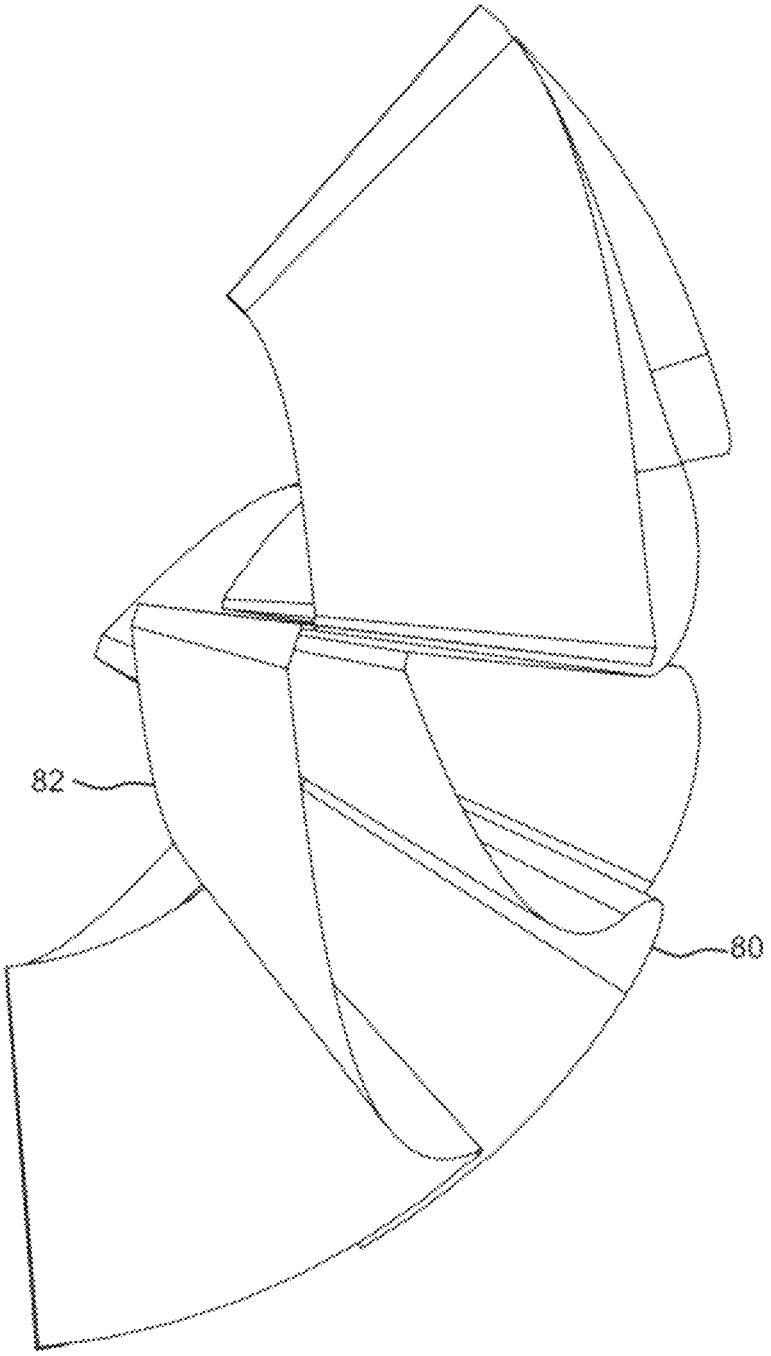
FIG. 25B shows a side view of the embodiment of FIG. 25.

FIGS. 23 and 24 illustrate timing gears 62/64 that may be designed for minimal backlash. These gears are not designed to take significant thrust load, but would rather be for torque transfer. In these two figures, the timing gears 62/64 have different pitch diameters 70/72, yet the number of teeth 66/68 on each gear is equal which is counter intuitive. By having the same number of teeth, an energy conversion device with a 1:1 speed ratio may be produced with indexing gears such as these. In an energy conversion device indexing arrangement requiring unequal speed ratios such as the indexers shown in the '674 patent application's FIGS. 68A-68D, an unequal number of gear teeth may be used to create the required speed ratio. The indexers (timing gears) that use spherical involute curves may operate at equal or non-equal speed ratios about shafts 74/76. The indexers may or may not have backlash control. For these energy conversion devices, backlash control may not be necessary all of the time, since often the torque is high enough in a single direction, that the fluid pressure can keep the clearance gaps 78 between rotors constant. Or, one can imagine that the torque at the drive shaft end would be generally high enough that at the point of minimum clearance, the involute timing gears would maintain contact with the opposing gear. In another embodiment, contact would be made substantially all the time, so as not to cause performance issues.

Backlash is usually mitigated by use of a single tooth that is wide enough such that both sides of the one tooth are in close proximity or contacting the opposite gear. In the embodiment of FIG. 24, the backlash is actually removed several teeth apart, or rather, the torque transmitting contact occurs at point(s) 212, 1 or 2 teeth away from the backlash removing point(s) 214 as the rotor surfaces 256 and 258 travel in rotational direction 250 about axes 252 and 254. The teeth providing for backlash removal at points 214, control or mitigate rotation of the rotor surface 256 in a direction opposite that shown by arrow 250, relative to the rotor surface 258. Such reverse relative rotation is defined as backlash.

More examples of indexers (or timing gears) utilizing the spherical involute geometry are shown in FIGS. 25-29. These Figs. show different embodiments of single direction torque designs of indexing gears 80/82 with 1:1 speed ratios, even though they have different pitch diameters. To maintain the involute gear contacts at the 1:1 speed ratio, the base circle diameters 26 of one gear 80 should be the same as the base circle diameter used to generate the geometry of the second gear 82. For speed ratios that are different than 1:1, the base circles would normally be unequal, and have a ratio equal to the speed ratio required.

Figure 26B:
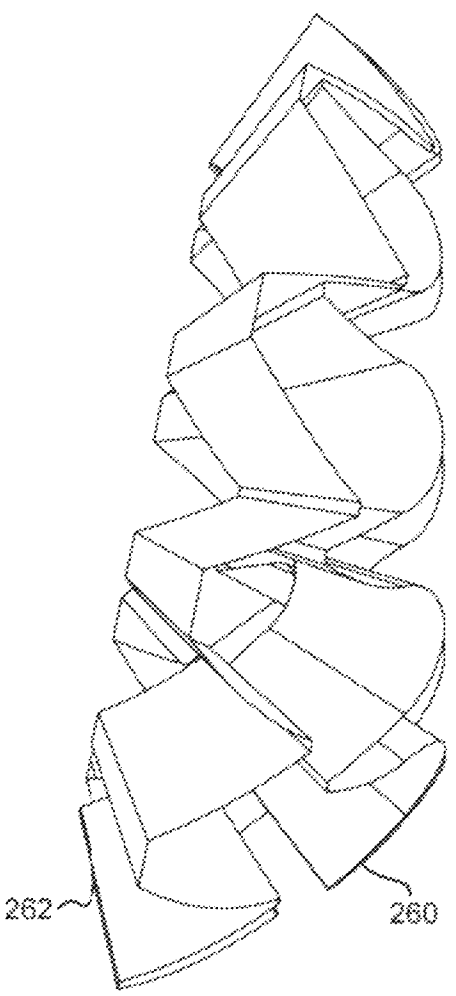
FIG. 26B shows a side view of the embodiment of FIG. 26.
Figure 26:
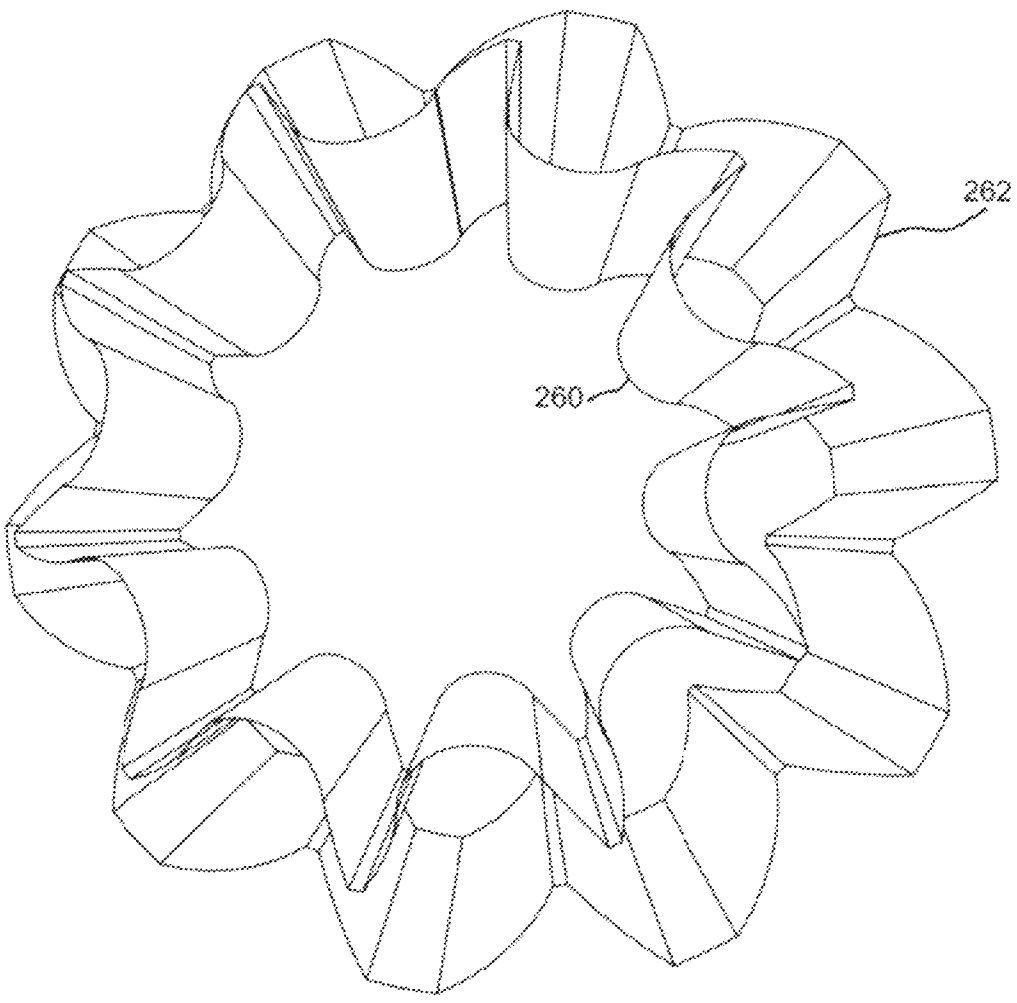
FIG. 26 shows a ten lobe embodiment with 12° beveled gears.

FIG. 26 shows the engagement surfaces of a ten lobe embodiment with 12° beveled gears 260, 262.

Figure 27B:
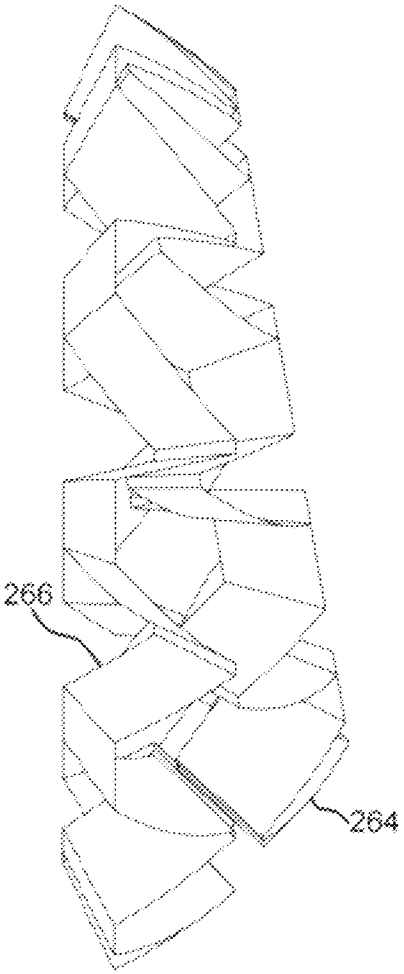
FIG. 27B shows a side view of the embodiment of FIG. 27.
Figure 27:
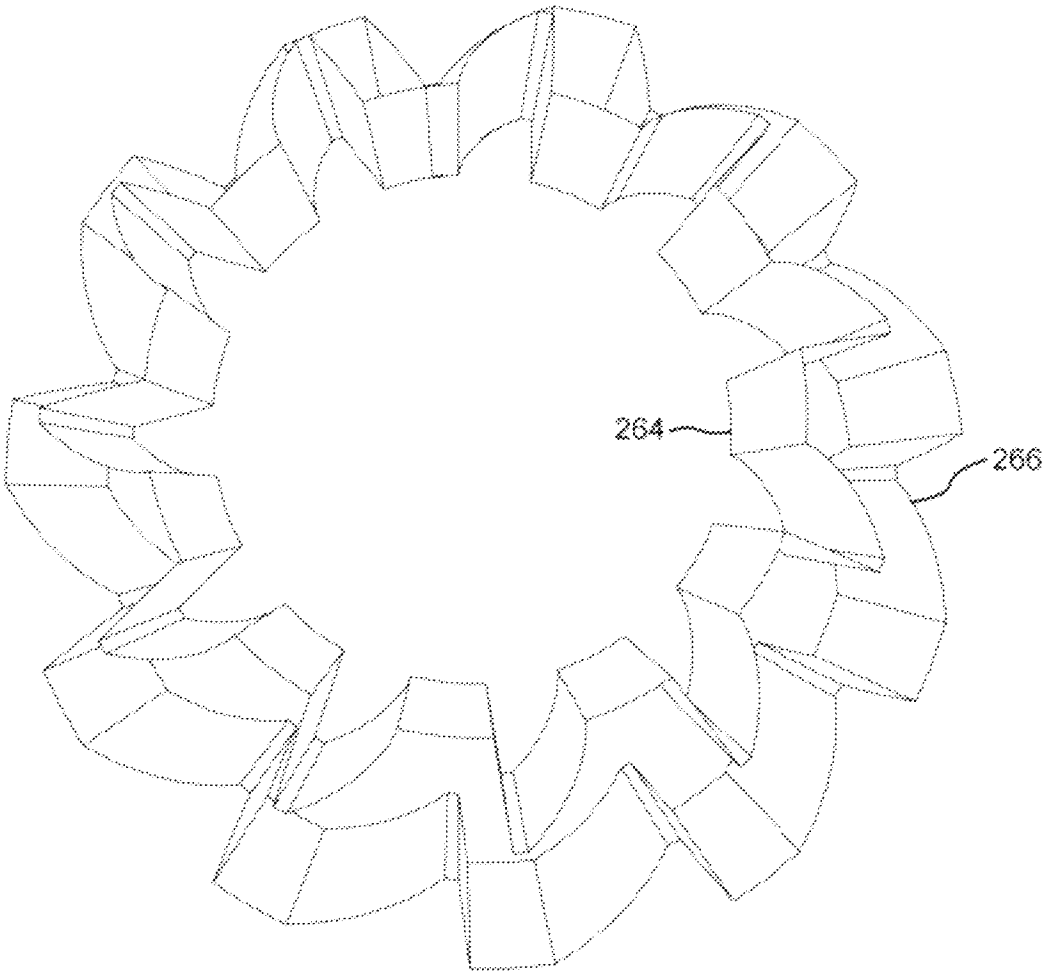
FIG. 27 shows the engagement surfaces of an eleven lobe embodiment with 10° involute gears.

FIG. 27 shows the engagement surfaces of an eleven lobe embodiment with 10° involute gears 264, 266.

Figure 28:
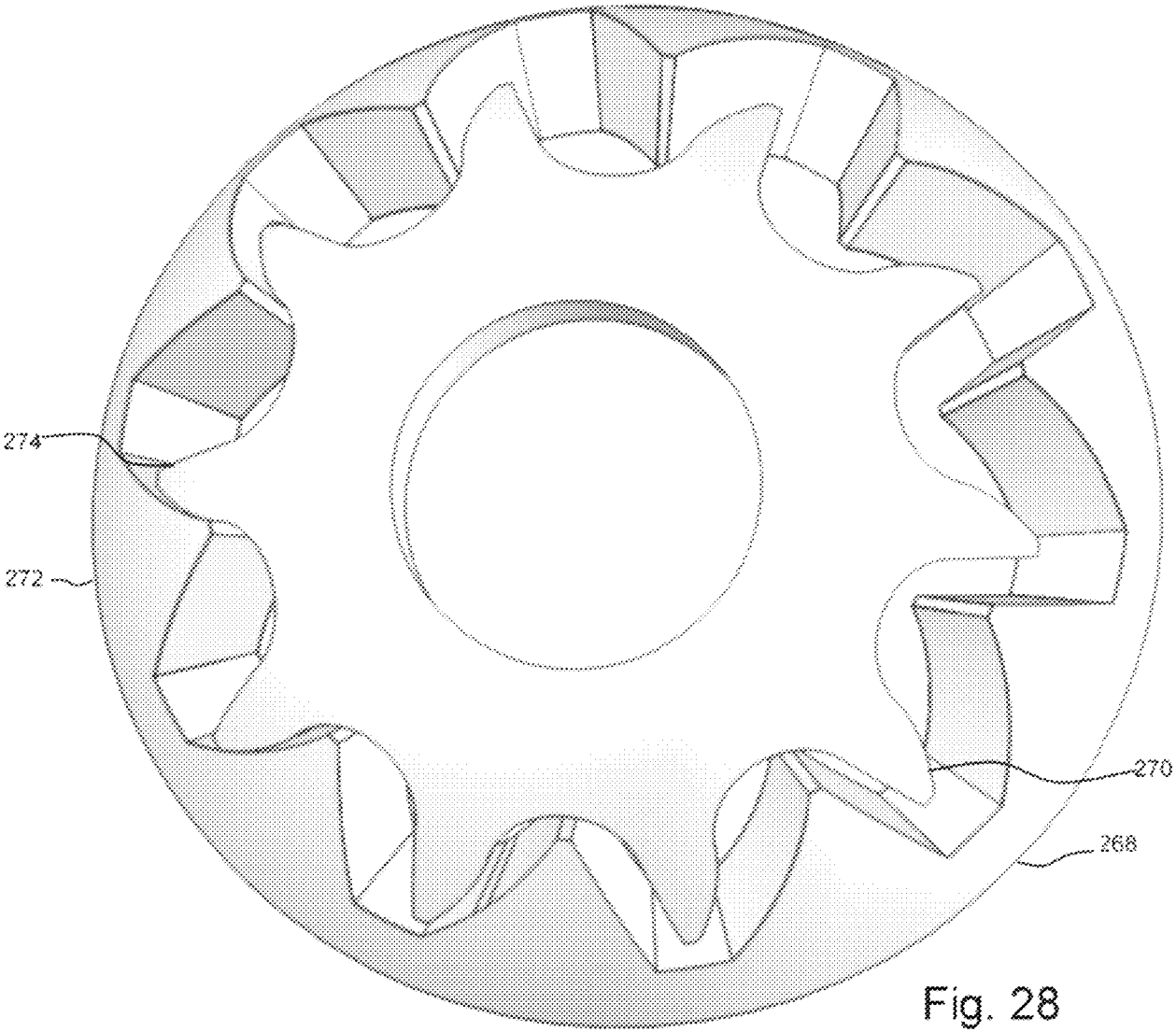
FIG. 28 shows a twelve lobed embodiment.

FIG. 28 shows an embodiment with rotors 268, 270 having twelve lobes 272, 274.

Figure 29:
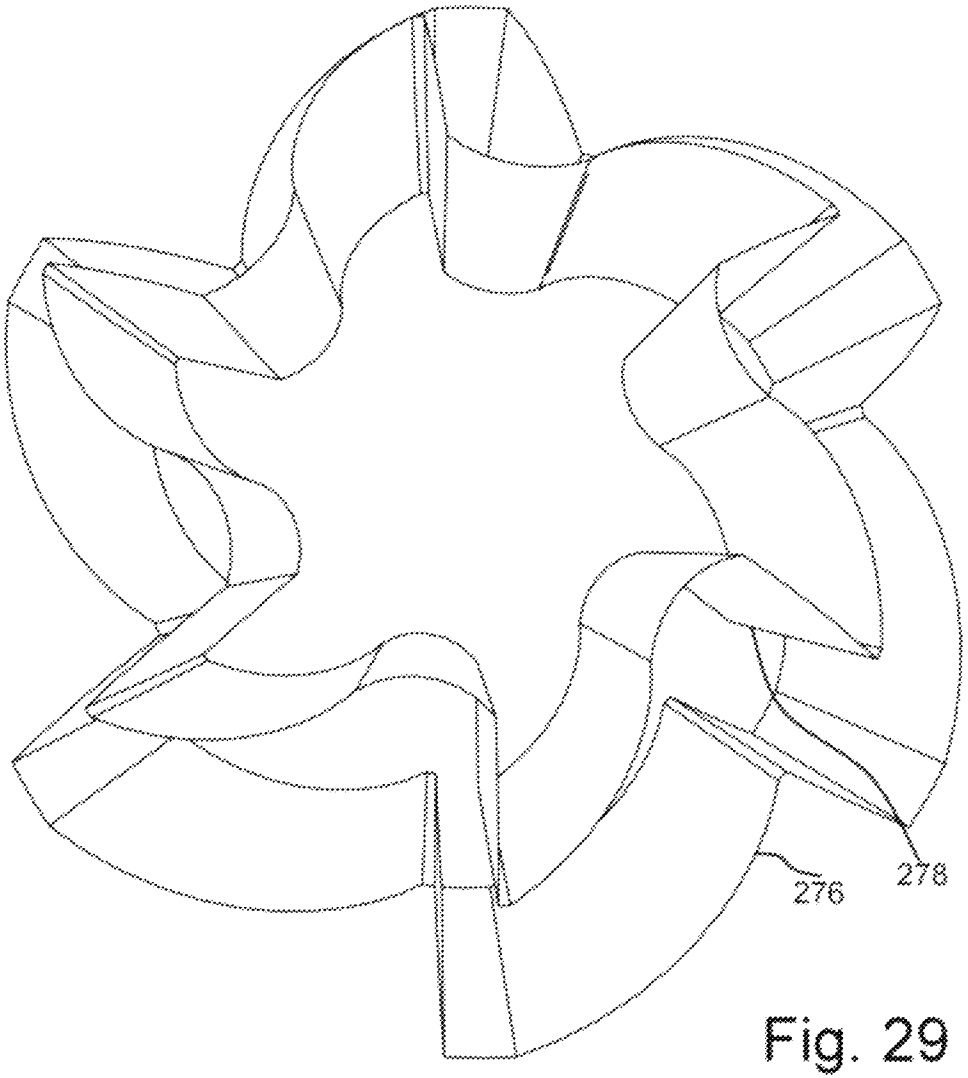
FIG. 29 shows the surfaces of a six-lobed embodiment with wider lobes than that shown in other embodiments.

FIG. 29 shows the surfaces 276, 278 of a six-lobed embodiment with wider lobes than that shown in other embodiments.

FIGS. 4 and 5 illustrate two rotors intermeshing around the entire circumference of the rotors 84, 86 with each other with axes that (approximately) intersect and are offset from collinear and spin at a 1:1 speed ratio. If one were to imagine an outer shroud, an inner ball, and appropriate porting at the front 216 and rear 218 of the device, with synchronous rotation, the elongated spherical involute surfaces 220, 222 could be used for example for a compressor, or for an expander. The surfaces shown are created by the spherically radial projection of the involutes inward toward the common origin of the spherical plane. The rotors need not be limited by this. For example, one may additionally apply a spiral transformation such as those illustrated in figures FIG. 30 and FIG. 31. In these two figures the intermeshing surfaces 114 are shown as very thin, but in operation they may be given some reasonable thickness.

While the use of a circular base curve has been used above, other shaped evolutes may be utilized For example, a peanut-shaped base cone may be utilized, resulting in some other kind of involute curve/surface.

While the present invention is illustrated by description of several embodiments and while the illustrative embodiments are described in detail, it is not the intention of the applicants to restrict or in any way limit the scope of the appended claims to such detail. Additional advantages and modifications within the scope of the appended claims will readily appear to those sufficed in the art. The invention in its broader aspects is therefore not limited to the specific details, representative apparatus and methods, and illustrative examples shown and described. Accordingly, departures may be made from such details without departing from the spirit or scope of applicants' general concept.

We claim:

1. A device comprising:

a first rotor and a second rotor;

the axes of the first rotor and the second rotor are offset from collinear and intersecting, each rotor comprising:

a spherical outer surface of radius R at least one lobe having a first circumferential side and a second circumferential side;

the first circumferential side of each lobe is a curved surface formed of at least one spherical involute curve;

the spherical involute curve is defined in Cartesian coordinates by the parametric curve;

$$\text{Involute} = \begin{bmatrix} X(t) \\ Y(t) \\ Z(t) \end{bmatrix} = \begin{bmatrix} R(\sin(t\sin(g))\sin(t) + \cos(t\sin(g))\cos(t)\sin(g)) \\ R[\cos(t\sin(g))\sin(g)\sin(t) - \sin(t\sin(g))\cos(t)] \\ R[\cos(t\sin(g))\cos(g)] \end{bmatrix}$$

t is the parametric curve parameter;

g=asin(r/R);

r is the radius of the base circle of the spherical involute;

B=t*sin(g); and each lobe of the first rotor intermeshes with the lobes of the second rotor, around the periphery of the rotors.

2. A device comprising:

a first rotor and a second rotor;

where the axes of the first rotor and the second rotor are offset from collinear and intersecting, each rotor comprising:

a spherical outer surface of radius R at least one lobe having a first circumferential side and a second circumferential side;

the first circumferential side of each lobe is a curved surface formed of at least one spherical involute curve;

where the spherical involute curve in Cartesian coordinates is defined by the parametric curve represented by the following matrix multiplication;

$$\text{Involute} = \begin{bmatrix} \cos(t) & -\sin(t) & 0 \\ \sin(t) & \cos(t) & 0 \\ 0 & 0 & 1 \end{bmatrix} \begin{bmatrix} \cos(g) & 0 & \sin(g) \\ 0 & 1 & 0 \\ -\sin(g) & 0 & \cos(g) \end{bmatrix} \begin{bmatrix} 1 & 0 & 0 \\ 0 & \cos(B) & -\sin(B) \\ 0 & \sin(B) & \cos(B) \end{bmatrix} \begin{bmatrix} 0 \\ 0 \\ R \end{bmatrix}$$

t is the parametric curve parameter;

g=asin(r/R);

r is the radius of the base circle of the spherical involute;

B=t*sin(g); and each lobe of the first rotor intermesh with a corresponding lobe of the second rotor, around the periphery of the rotors.

3. The device as recited in claim 2 wherein the first circumferential side of each lobe of the first rotor contacts the first circumferential side of associated lobes on the second rotor.

4. The device as recited in claim 3 wherein the second circumferential side of each lobe of the first rotor contacts the second side of associated lobes on the second rotor.

5. The device as recited in claim 3 further comprising undercuts in the second surfaces of the lobes.

6. The device as recited in claim 3 wherein the second side of the lobe is a teardrop shape in cross section to maintain relative spacing to the lobe tip of the opposing rotor.

7. The device as recited in claim 3 wherein the second circumferential side of the lobe is in preloaded contact with the second circumferential side of the opposing rotor.

8. The device as recited in claim 2 wherein the first circumferential side of each lobe of the first rotor does not contact the first circumferential side of associated lobes on the second rotor, such that a gap is maintained between the first circumferential side of each lobe of the first rotor and the first circumferential side of associated lobes on the second rotor.

9. The device as recited in claim 2 wherein both the first circumferential sides and second circumferential sides of the lobes are comprised of involute curves.

10. The device as recited in claim 2 further comprising:

a housing having a prescribed gap between an outside diameter of the first rotor, and an inside diameter of housing, the housing having a prescribed gap between an outside diameter of the second rotor, and the inside diameter of housing, and a gap between the first sides of the lobes of the first rotor and the first sides of the lobes of the second rotor wherein the gap varies through rotation of the first rotor and second rotor.

11. The device as recited in claim 10 further comprising:

a shroud encompassing the first rotor, and the second rotor;

the shroud in contact with the outside diameters of the first rotor and a gap or sealing contact with the second rotor, wherein the shroud rotates with the first and second rotor, and;

the shroud positioned within the housing.

12. The device as recited in claim 10 further comprising:

a substantially spherical ball centered at the common center of intersection of axis of rotation of the first and second rotors, and a gap between an inner spherical surface of at least one rotor and an outer diameter of the ball.

13. The device as recited in claim 10, where at least one rotor comprises fluid inlet and/or outlet ports that are ported through a rear face of the rotor.

14. The device as recited in claim 10 where the number of spherical involute derived surfaces is one per rotor.

15. The device as recited in claim 10 where lobe spherical involute curves on each rotor have a helical-like shape where the surface spans around a rotor close to, equal to or greater than 360 degrees and result in a fluid action during rotation of the rotors that is substantially in the axial direction.

16. The device as recited in claim 15 wherein:

the involute curves span greater than 360 degrees around the rotor, and portions of the lobes form fins;

where both sides of the fins are comprised of involute surfaces; and the fins of the lobes on the first rotor engage fins of the lobes of the second rotor.

17. The device as recited in claim 15 where spherical involute lobe surfaces comprise a spiral transformation wherein the involute curves on respective spherical planes that construct the lobe surfaces radiate outward from a common center and where each spherical involute on each respective spherical plane is rotated about the rotor axis by a rotation value.

* * * * *